US008613547B2

(12) United States Patent
Steele

(10) Patent No.: US 8,613,547 B2
(45) **Date of Patent: *Dec. 24, 2013**

(54) PACKAGES HAVING BUBBLE-SHAPED CLOSURES

(76) Inventor: Mark Steele, New Prague, MN (US)

( * ) Notice: Subject to any disclaimer, the term of this patent is extended or adjusted under 35 U.S.C. 154(b) by 997 days.

This patent is subject to a terminal disclaimer.

(21) Appl. No.: 12/116,726

(22) Filed: May 7, 2008

(65) Prior Publication Data

US 2008/0279485 A1 Nov. 13, 2008

Related U.S. Application Data

(63) Continuation-in-part of application No. 11/737,866, filed on Apr. 20, 2007, now Pat. No. 7,883,268, which is a continuation of application No. 11/268,674, filed on Nov. 7, 2005, now Pat. No. 7,207,717.

(60) Provisional application No. 60/625,391, filed on Nov. 5, 2004, provisional application No. 60/916,442, filed on May 7, 2007, provisional application No. 60/917,078, filed on May 10, 2007, provisional application No. 60/952,311, filed on Jul. 27, 2007, provisional application No. 60/987,588, filed on Nov. 13, 2007.

(51) Int. Cl.
*B65D 33/16* (2006.01)

(52) U.S. Cl.
USPC ..... 383/63; 383/38; 383/10

(58) Field of Classification Search
USPC ..... 383/63, 93, 65, 59, 45; 24/585.11, 24/585.1, 584.1
See application file for complete search history.

(56) References Cited

U.S. PATENT DOCUMENTS 2,460,853 A 2/1949 Siple
2,715,759 A 8/1955 Poux (Continued)

FOREIGN PATENT DOCUMENTS

EP 0213673 3/1987
EP 0213673 A1 3/1987

(Continued)

OTHER PUBLICATIONS

WO 2006/052800 International Search Report attached, May 10, 2007.

(Continued)

*Primary Examiner* — Gary Elkins
*Assistant Examiner* — Christopher Demeree
(74) *Attorney, Agent, or Firm* — Skaar Ulbrich Macari, P.A.

(57) ABSTRACT

A package having fluid-filled chambers that form a line of contact that seals the package. The package generally defines an interior cavity accessible through an opening. Opposing portions of the opening may include at least one fluid-filled chamber to seal the package. The chamber may be held in sealing contact with an opposing structure or with each other by fastening means that hold the opposing portions together. In another embodiment, opposing chambers themselves may interlock to maintain sealed contact. The package may include an auxiliary opening so that an end user can fill the package with articles of the user's choice. The auxiliary opening can be sealed at least over a portion of its length. In another embodiment, first and second compartments are isolated by the fluid-filled chamber seal, with the seal being selectively breachable to enable transfer of product from the first to the second compartment.

16 Claims, 20 Drawing Sheets

(56) References Cited

U.S. PATENT DOCUMENTS

| | | | | |
|---|---|---|---|---|
| 2,720,903 | A | 10/1955 | Pickren | |
| 2,785,824 | A | 3/1957 | Reeves | |
| 2,994,117 | A | 8/1961 | Breniman | |
| 3,025,629 | A | 3/1962 | Sears | |
| 3,058,187 | A | 10/1962 | Gugen | |
| 3,102,570 | A | 9/1963 | Fairchilds | |
| 3,133,575 | A | 5/1964 | Slemmons | |
| 3,151,650 | A | 10/1964 | Beck | |
| 3,224,640 | A | 12/1965 | Schneider et al. | |
| 3,339,721 | A | 9/1967 | Goldstein | |
| 3,343,233 | A | 9/1967 | Russell | |
| 3,367,380 | A | 2/1968 | Dickey | |
| 3,390,507 | A | 7/1968 | Repko | |
| 3,542,032 | A | 11/1970 | Spencer et al. | |
| 3,874,115 | A | 4/1975 | London et al. | |
| 4,155,453 | A | 5/1979 | Ono | |
| 4,209,115 | A | 6/1980 | Stahl | |
| 4,313,609 | A | 2/1982 | Clements | |
| 4,519,499 | A | 5/1985 | Stone et al. | |
| 4,588,554 | A | 5/1986 | Kaartinen et al. | |
| 4,703,518 | A | 10/1987 | Ausnit | |
| 4,806,021 | A | 2/1989 | Koudstaal et al. | |
| 4,874,093 | A | 10/1989 | Pharo | |
| 4,877,334 | A | 10/1989 | Cope | |
| 4,913,561 | A | 4/1990 | Beer | |
| 4,923,701 | A | 5/1990 | VanErden | |
| 5,050,736 | A | 9/1991 | Griesbach et al. | |
| 5,080,248 | A | 1/1992 | Stocchiero | |
| 5,120,553 | A | 6/1992 | Kupcikevicius | |
| 5,209,347 | A | 5/1993 | Fabisiewicz et al. | |
| 5,335,478 | A | 8/1994 | Aronsen | |
| 5,447,235 | A | 9/1995 | Pharo | |
| 5,535,888 | A | 7/1996 | De Luca | |
| 5,558,438 | A | 9/1996 | Warr | |
| 5,692,837 | A | 12/1997 | Beer | |
| 5,743,443 | A | 4/1998 | Hins | |
| 5,803,256 | A | 9/1998 | Lydhig et al. | |
| 5,882,117 | A | 3/1999 | Laffon | |
| 5,971,613 | A * | 10/1999 | Bell | 383/107 |
| 6,020,013 | A | 2/2000 | Kozma | |
| 6,036,004 | A | 3/2000 | Bowen | |
| 6,053,635 | A | 4/2000 | Anderson et al. | |
| 6,065,873 | A | 5/2000 | Fowler | |
| 6,164,822 | A | 12/2000 | Beer | |
| 6,186,663 | B1 | 2/2001 | Ausnit | |
| 6,193,416 | B1 | 2/2001 | Kawamata et al. | |
| 6,203,535 | B1 * | 3/2001 | Barney et al. | 604/408 |
| 6,245,367 | B1 | 6/2001 | Galomb | |
| 6,352,365 | B1 | 3/2002 | Healy et al. | |
| 6,375,037 | B1 | 4/2002 | Bell et al. | |
| 6,376,035 | B1 | 4/2002 | Dobreski | |
| 6,481,183 | B1 | 11/2002 | Schmidt | |
| D468,195 | S | 1/2003 | Bell | |
| 6,533,711 | B1 | 3/2003 | Anderson et al. | |
| 6,572,267 | B1 | 6/2003 | Forman | |
| 6,616,333 | B2 | 9/2003 | Kinigakis et al. | |
| 6,629,777 | B2 | 10/2003 | Tanaka et al. | |
| 6,641,307 | B2 | 11/2003 | Matsuda et al. | |
| 6,726,364 | B2 | 4/2004 | Perell et al. | |
| 6,789,945 | B2 | 9/2004 | Mobs et al. | |
| 6,854,886 | B2 | 2/2005 | Piechocki et al. | |
| 6,910,995 | B2 | 6/2005 | Schneider et al. | |
| 6,938,394 | B2 | 9/2005 | Perell | |
| 6,968,952 | B2 | 11/2005 | Crevier et al. | |
| 7,040,810 | B2 | 5/2006 | Steele | |
| 7,048,442 | B2 | 5/2006 | Schneider et al. | |
| 7,207,717 | B2 | 4/2007 | Steele | |
| D549,594 | S | 8/2007 | Steele | |
| 7,340,807 | B2 | 3/2008 | Dais et al. | |
| 2001/0030134 | A1 | 10/2001 | Goglio et al. | |
| 2002/0154835 | A1 | 10/2002 | Galomb | |
| 2003/0147565 | A1 | 8/2003 | Plourde et al. | |
| 2003/0219174 | A1 | 11/2003 | Piechocki | |
| 2004/0031244 | A1 | 2/2004 | Steele | |
| 2004/0045854 | A1 | 3/2004 | Bergerioux et al. | |
| 2004/0057638 | A1 | 3/2004 | Perell et al. | |
| 2004/0231292 | A1 | 11/2004 | Perell | |
| 2005/0069227 | A1 | 3/2005 | Steele | |
| 2005/0139603 | A1 | 6/2005 | Lee | |
| 2006/0126970 | A1 | 6/2006 | Perell | |
| 2006/0215942 | A1 | 9/2006 | Steele | |
| 2007/0189641 | A1 | 8/2007 | Steele | |
| 2007/0278114 | A1 | 12/2007 | Kane et al. | |
| 2008/0002918 | A1 | 1/2008 | Steele | |
| 2008/0286420 | A1 | 11/2008 | Domingues et al. | |
| 2009/0180716 | A1 | 7/2009 | Steele | |
| 2009/0208147 | A1 | 8/2009 | Steele | |
| 2009/0238499 | A1 | 9/2009 | Steele | |
| 2009/0245699 | A1 | 10/2009 | Steele | |
| 2009/0277916 | A1 | 11/2009 | Steele | |

FOREIGN PATENT DOCUMENTS

| | | | |
|---|---|---|---|
| EP | 1812318 | A2 | 8/2007 |
| EP | 1812318 | | 7/2011 |
| EP | 2364922 | | 9/2011 |
| EP | 2364922 | A2 | 9/2011 |
| JP | 2005022760 | A | 1/2005 |
| WO | 9824702 | A1 | 6/1998 |
| WO | WO 98/24702 | | 6/1998 |
| WO | WO 01/51367 | | 7/2001 |
| WO | WO 2005/123196 | | 12/2005 |
| WO | WO 2006/052800 | | 5/2006 |
| WO | WO 2008/137937 | | 11/2008 |

OTHER PUBLICATIONS

WO 2006/052800 International Preliminary Report on Patentability attached, Jun. 19, 2007.

WO 2008/137937 International Search Report attached, Oct. 27, 2008.

WO 2008/137937 International Preliminary Report on Patentability attached, Nov. 10, 2009.

U.S. Appl. No. 11/737,866 (Parent) Non-Final Rejection attached, Jul. 24, 2009.

EP 2364922 (foreign family application) European Search Report attached, Dec. 11, 2012.

EP 2364922 (foreign family application) Partial European Search Report attached, Aug. 22, 2011.

EP 2364922 (foreign family application) Extended European Search Report attached, International Search Report attached, Dec. 8, 2011.

EP 1812318 (foreign family application) Extended European Search Report attached, May 3, 2010.

EP 1812318 (foreign family application) Intent to Grant European Patent, Jan. 31, 2011.

EP 2152597 (foreign family application) Extended European Search Report attached, May, 24, 2011.

EP0582558.9 (EP) application Extended European Search Report, May 3, 2010.

EP08747792.3 (EP) application Extended European Search Report, May 24, 2011.

EP11168199.5 (EP) application Extended European Search Report, Dec. 8, 2011.

EP08747792.3 (EP) application, European Patent Office, Office Action Communication, Aug. 19, 2013.

* cited by examiner

PACKAGES HAVING BUBBLE-SHAPED CLOSURES

RELATED APPLICATIONS

This application is a continuation-in-part of U.S. patent application Ser. No. 11/737,866, filed Apr. 20, 2007, which is a continuation of U.S. patent application Ser. No. 11/268,674, filed Nov. 7, 2005, now U.S. Pat. No. 7,207,717, issued Apr. 24, 2007, which claims priority to U.S. Provisional Application Ser. No. 60/625,391, filed Nov. 5, 2004. This application also claims priority to U.S. Provisional Application Ser. No. 60/916,442, filed May 7, 2007, to U.S. Provisional Application Ser. No. 60/917,078, filed May 10, 2007, to U.S. Provisional Application Ser. No. 60/952,311, filed Jul. 27, 2007, and to U.S. Provisional Application Ser. No. 60/987,588, filed Nov. 13, 2007. The disclosures of the above referenced applications are hereby incorporated by reference herein in their entirety.

FIELD OF THE INVENTION

The present invention relates generally to flexible packaging and, more particularly, to packages, and methods for manufacturing and using packages, having fluid actuated closures and secondary closures or seals.

BACKGROUND OF THE INVENTION

Conventional flexible packages generally include external or integrated sliding means or other similar devices designed to allow a user to selectively gain access into the pouch or package. Traditionally, non-integrated, twist ties and other tying means have also been used to close an open-end portion of a flexible package. These devices often require the manufacturing of additional and often costly materials and/or devices into the packages.

Due to the problems associated with external closure devices for packages, the industry has developed integrated closeable devices. U.S. Pat. Nos. 4,913,561, 5,692,837, and 6,186,663 disclose such packaging. Current typical reclosable devices, most commonly known as zippers, tend to be pre-made at separate manufacturing sites and then shipped to the site where the actual package is manufactured. The reclosable device is then introduced into the packaging machinery and typically heat sealed into or onto the package. These reclosable devices usually are comprised of two pieces that have been mated together by male and female interlocking members. The mating process is usually performed by either pinching the two interlocking members together (press-to-close mechanism) or sliding a mechanism (zipper mechanism) along the top of the reclosable device, which causes the two interlocking members to be interlocked.

These press-to-close closure mechanisms are sometimes difficult to align when attempting to mate together, often causing a failure of a true closure. Furthermore, when a packager is filling the package through the press-to-close closure mechanism, and when the consumer is pouring the contents out of the package, small pieces of the product can get caught in tracks of the mating interlocking members, causing a breach across the interlocking components and hampering any positive seal. The compromise of the integrity of the seal between the mating locking components may also be caused by localized crushing (e.g., proximate side seal) of the interlocking members during manufacturing, shipping, handling, and use by the consumer. The localized crushing need only be enough to plastically deform either of the interlocking members to cause a leak.

Further, most zipper-type closure mechanisms merely serve to close off the top portion of the package by pulling or forcing together the top portions of the front and back panels of the package. This zipper-type closure mechanism has two significant drawbacks. First, it reduces the internal holding volume of the package since, in a closed position, side gussets of the package are forced to contact at an end proximate the access opening. Second, a space or gap can remain when the zipper-type closure mechanism is in its closed position. The gap permits air to flow in and out of the package. Although the zipper-type closures may be easier for some consumers to operate, and may have a more positive closure with respect to the press-to-close closure mechanism, they can be expensive and, like the press to close closure mechanisms, often do not create an ideal barrier after the package has been opened by the consumer for the first time.

Some designs of the zipper and press-to-close mechanisms are suitable for maintaining a water or liquid tight seal. However, the interlocking members of both the zipper and the press-to-close closure mechanisms may also allow for fluid leakage and they may undergo plastic deformation after repeated use that adversely affects the ability of the mechanism to seal fluids. Moreover, the zipper and press-to-close mechanisms may not be suitable for a gas tight seal. Accordingly, the contents of the package are susceptible to oxidation and other air-borne problems, such as the release of odors.

As a result, there is a need for a flexible package that substantially solves the above-referenced problems with conventional package designs, configurations, and manufacturing methods.

SUMMARY OF THE INVENTION

A purpose of the present invention is to allow for a package, such as a flexible package, to be opened and reclosed with a simple squeezing motion, to maintain a higher barrier against oxygen transmission after the package has been initially opened by the consumer, and/or to provide a one-way release valve, if desired. The various embodiments and teachings provided herein can also be employed with a rigid or semi-rigid package.

Embodiments of the present invention are directed to device for sealing a package that generally includes at least one front and back member joined at least partially together, the members each defining the boundary of an access opening. The members may be panels of a package, the package defining an interior cavity accessible through the access opening. The interior is capable of storing and dispensing product and other objects or materials. Further, at least one web member can be joined to each of the front and back panel portions respectively to form at least two generally parallel chambers and/or channels that extend generally along at least a portion of the access opening. In one embodiment, the chamber or chambers each include a reservoir or storage portion and a closure portion in fluid communication. In another embodiment, the chamber(s) is/are each one contiguous chamber that spans substantially the entire opening.

In some embodiments, a fluid such as a gas (e.g., air), liquid, gel or other like fluid is disposable in each of the chambers during manufacture such that the reservoir portion and/or the closure portion are generally inflated or expanded. A fluid regulator may be formed and/or disposed between the reservoir portion and the closure portion of each of the chambers to regulate the transfer and/or flow of fluid therebetween.

In use, to close the access opening a user squeezes or applies a force or pressure to the inflated reservoir portions. The pressure causes the fluid to flow through to the closure portions of the chambers, and through the fluid regulator if included. The inflow of fluid causes the closure portions to inflate and generally confront or seat against each other and selectively block the access opening. To provide access to the interior of the package a user may squeeze the closure portions of the chambers, which causes the fluid to flow through the fluid regulator and into the reservoir portions. As the fluid flows into the reservoir portions, the closure portions deflate permitting a user to access the interior of the package.

For various embodiments, a pair of thin-walled, fluid-filled chambers, one each on opposing sides of a bag or package (e.g., flexible, rigid or semi-rigid) proximate the opening of the bag, span the width of a flexible bag and are arranged to contact each other to form a seal when the opening is closed. Because of the thin-walled design, the forces required to maintain a seal therebetween are well within the elastic limits of the chamber material for a repeatable sealing performance over the life of the package. The opening to the bag may be closed by conventional means used in the packaging industry, such as by zipper closures, press-to-close closures, hook and loop fabric fasteners, tin-tie closures, snaps or other techniques available to the artisan. The closure mechanism causes the opening to remain closed and the fluid-filled chambers to maintain contact with each other across the length of the opening. In this way, the closure mechanism may provide a primary closure and the contacting fluid-filled chambers may provide a secondary seal, which can provide a leak proof or air tight package or opening.

Some embodiments include more than one fluid-filled chamber located on each side the bag, and may be positioned so that the fluid-filled chambers on opposing sides of the bag interlock. The interlocking chambers may be supplemental to a primary closure mechanism and provide a secondary seal, or the interlocking chambers may be the sole closure mechanism.

Certain embodiments may comprise flexible packages with fluid-actuated closures that include an auxiliary or bypass opening that provides an alternative access to the interior of the flexible package. The auxiliary opening may run substantially parallel with the fluid actuated opening and may run substantially the entire width of the flexible package to enable an end user to easily fill the interior with articles of the user's choice. The flexible package is equipped with means for sealing the auxiliary opening, such as a zipper, pinch lock, adhesive or other closing mechanisms available to the artisan. After disposing the articles in the interior, the sealable portion of the auxiliary opening is sealed shut. The flexible packages may be provided to the end user in an empty state so the end user can fill it with the articles of his or her choosing.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which:

FIGS. 3-3*a* are cross-section views of the embodiment of FIG. 2 having various inflated closure portions and a top seal;

Figure 1:
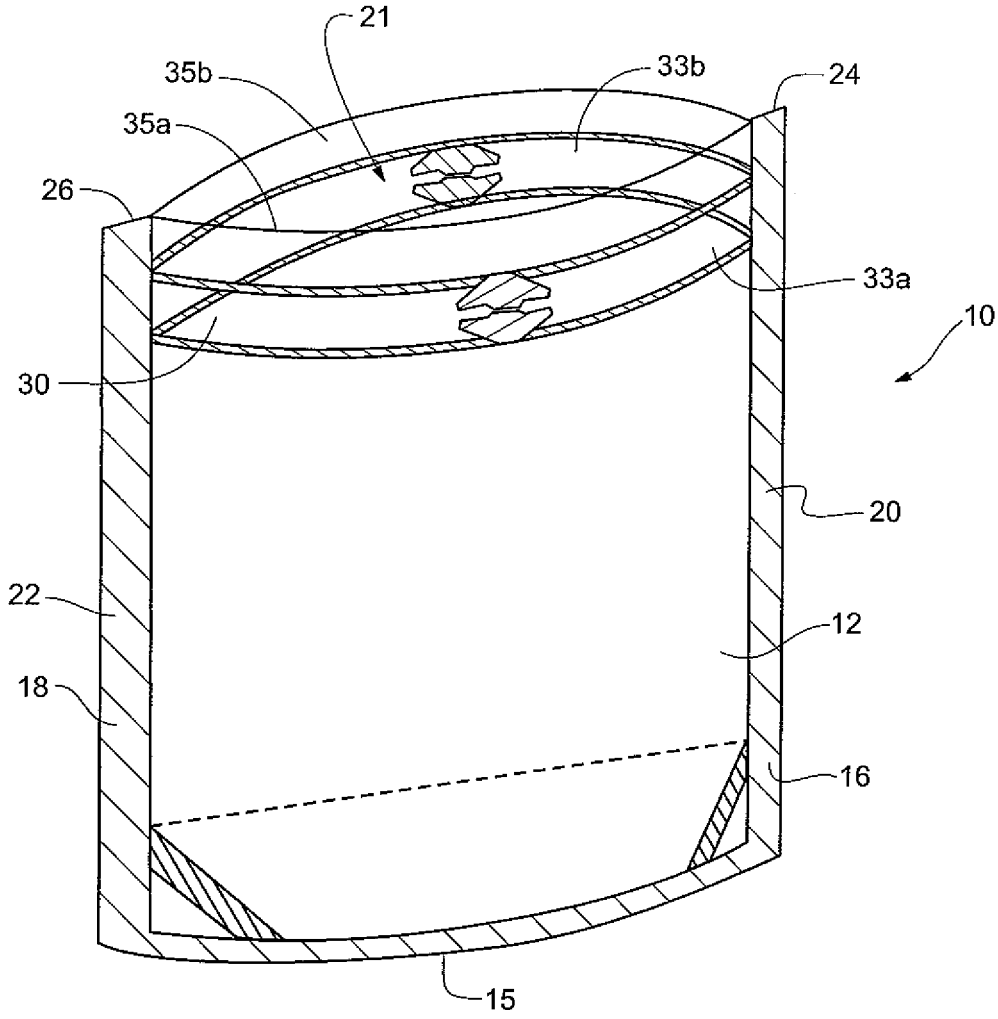
FIG. 1 is a perspective view of one embodiment of a flexible package having a fluid actuated closure mechanism, with the top of the package unsealed.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is provided to demonstrate sealed portions and/or integrated devices for the package.

DETAILED DESCRIPTION OF THE INVENTION

Figure 3:
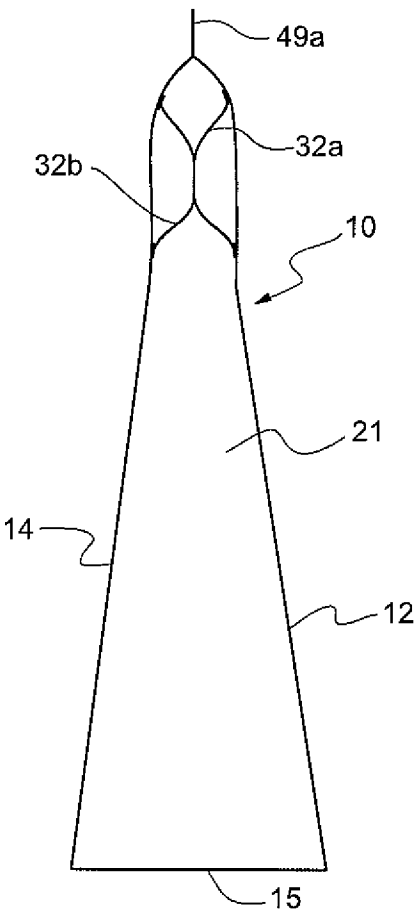
Figure 2:
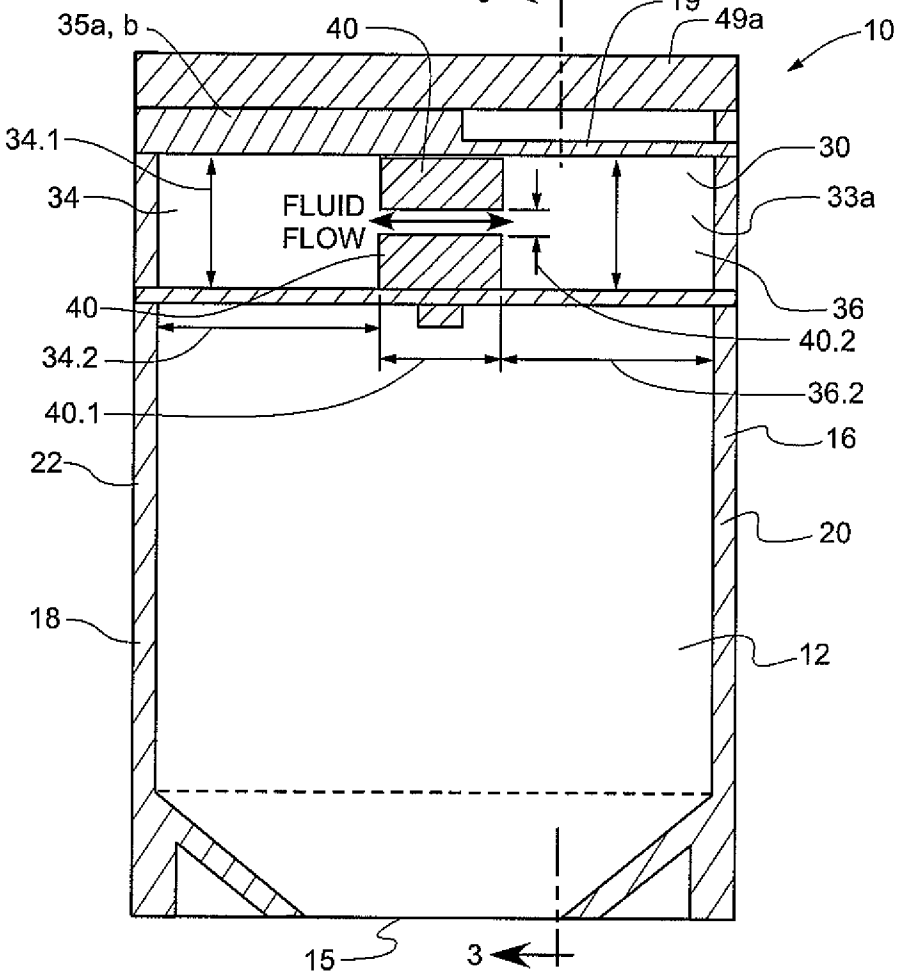
FIG. 2 is a front view of one embodiment of a flexible package having a fluid chamber with a reservoir portion and a closure portion.

Referring generally to FIGS. 1-16, a flexible package 10 in accordance with the present invention is shown. Referring generally to FIGS. 1-3, the package 10 generally includes a front panel portion 12, a back panel portion 14. Further, a bottom panel portion 15, gusseted or non-gusseted, can be included, especially in those embodiments defining a stand up package. The joining and/or shaping of the panels 12, 14, 15, generally define an inner cavity 21 having an adjustable internal volumetric capacity. The inner cavity 21 is capable of storing, transporting and/or dispensing product or other objects and material therein. Side panel portions (not shown), gusseted or non-gusseted, may also be included. The panel portions 12-15 are often referred to as webs, films or layers.

The package panel portions 12-15 are generally constructed of a flexible sheet material such as polyethylene, polyester, metal foil, polypropylene, or polyethylenes laminated with other materials such as nylon, polyester, and like films. To provide for higher barriers, embodiments can use combination layers of said materials and materials of the like. Generally, in such embodiments, a material having preferred sealing characteristics can be joined or bonded to a material having a different preferred characteristic (i.e., beneficial oxygen barrier properties). Preferably, the package of the present invention is to be formed into a stand-up pouch, but it could be a pouch that displays lying down, or in other package and pouch shapes and configurations known to one skilled in the art.

In one embodiment, the front panel portion 12 and the back panel portion 14 will be formed of one contiguous web material. In alternative embodiments, at least one of the panel portions 12-15 can be distinct web materials joined or sealed to other respective panel portions to form the package 10 of the present invention. For instance, the front panel portion 12 and the back panel portion 14 can be joined to each other from distinct non-contiguous web sheets of material, and one of said panel portions 12-14 can further extend to define the bottom panel portion 15. The bottom panel portion 15 in the various configurations forming a stand up pouch can include a gusset known to those skilled in the art to further promote operative expansion and contraction of the package 10 and its respective capacity in accordance with the receipt and removal of material within the package 10.

The front panel portion 12 generally includes a first front longitudinal edge 20 and a second front longitudinal edge 22. Both of said front panel longitudinal edges 20, 22 may be substantially parallel to each other and extend along the longitudinal length of the front panel portion 12. Likewise, the back panel portion 14 generally includes a first back longitudinal edge 24 and a second back longitudinal edge 26, also substantially parallel to each other and spanning the longitudinal length of the back panel portion 14.

In one embodiment, the first front longitudinal edge 20 can be sealably joined to the first back longitudinal edge 24 along the length of the edges 20, 24 to form first side seal 16. Similarly, the second front longitudinal edge 22 can be sealably joined to the second back longitudinal edge 26 along the length of edges 22, 26 to form second side seal 18. These side seals 16, 18 generally define the side boundaries of the package 10 and can be sealably joined using heat, adhesive, and other bonding techniques known to one of ordinary skill in the art.

Referring to FIGS. 1-4, the flexible package 10 includes a fluid actuated closure 30 attached to or integrated to the flexible package 10 to permit a user to selectively reclose the access opening 19. In one embodiment of the invention, the fluid actuated closure 30 includes at least one first web barrier or layer 32*a* joined to an inner surface of the front panel portion 12 of the package 10 and at least one second web barrier or layer 32*b* joined to an inner surface of the back panel portion 14 of the package 10, such that the first 32*a* and second 32*b* web barriers are generally opposed (e.g. FIG. 3). Alternatively, only one web barrier or layer 32*a* joined to an interior of a panel portion (e.g., front panel portion 12, as depicted in FIG. 3A), such that the barrier 32*a* confronts the interior of the opposing panel portion (e.g., back panel portion 14) or some other structure of the package 10 to provide selective opening, closing of the package 10 through sealing of the access opening 19 as described herein. When the access opening 19 and fluid actuate closure 30 are positioned along a limited portion of the package (e.g., an opening into a moist toilette container or package), the closure permits a liquid and air seal to preserve the contents after the initial opening of the package.

The front 12 and back 14 panel portions and the first 32*a* and second 32*b* web barriers can define at least two fluid chambers or tubes 33*a* and 33*b* that extend generally along a long axis of the access opening 19, generally transverse to the side seals. In another embodiment, the fluid chambers 33*a* and 33*b* may be a laminate formed by trapping or positioning a barrier film between two layers of a sealant film, preferably a Nylon or EVOH barrier film co-extruded between two layers of polyethylene. The fluid chambers 33*a* and 33*b* are sealed into the top section of the package 10 where typically air, or gas, liquid, or a similar item, is introduced between the first web barrier 32*a* and the front panel portion 12 of the package 10 and between the second web barrier 32*b* and the back panel portion 14 of the package 10, or if using tubes, it will be introduced into the tubes. This will create one or more generally opposed balloon type bubbles in a top portion or section of the package 10. Further, the barrier or layers 32*a*, 32*b* and corresponding chambers 33*a*, 33*b* can be formed from a portion of the package 10, such as by folding a part of the package 10 or the respective panels 12, 14 over to create a fluid containable chamber or layer.

Each of the fluid chambers 33*a* and 33*b* may include one or more reservoir or storage portions 34 having a nominal width 34.1 and a nominal height 34.2, as well as one or more closure portions 36 having a nominal width 36.1 and a nominal height 36.2 and in fluid communication with the reservoir portion 34 through a fluid regulator 40. As shown in the package 10 of FIGS. 1, 2 and 4, portions 35*a*, 35*b* of the package above the respective reservoir portions 34 of the chambers 33*a*, 33*b* are joinable from edge 22 to a point generally short of edge 20, preferably proximate the fluid regulator 40, using known joining or sealing techniques. As such, access into the internal cavity 21 of the package 10 is generally limited to the access opening 19 proximate the closure portion 36 as the portion above the reservoir portion 34 is closed off. Other embodiments are envisioned where the access opening 19 and portions 34, 36 are positioned elsewhere along the package 10 (e.g., along one or more of the side, or front and back panels).

The fluid regulator 40 may be formed and/or disposed between the reservoir portion 34 and the closure portion 36 of each of the chambers 33*a* and 33*b* to regulate the transfer and/or flow of fluid therebetween. The fluid regulator 40 may simply be a narrow channel 41 of two opposing but proximate film portions or materials, as depicted in the figures. The narrow channel 41 may be characterized by a length 40.1 and a throat major dimension 40.2. The two opposing film portions may also define a minor throat dimension (not depicted), or be in contact with each other to provide a restrictive flow passage. The fluid regulator 40 may also comprise various one-way or two-way valve devices, or a myriad of other known regulators or methods and techniques of regulating fluid flow through such channels known to one of ordinary skill in the art (not depicted). Generally, movement of the fluid from the reservoir portion 34 into the closure portion 36 of each of the fluid chambers 33*a* and 33*b* seals the access opening 19 of the package 10. The opening 19 is sealed due to the conforming abutment or seating of the inflated portions 36 against one another. Likewise, movement of the fluid from the closure portion 36 of each of the fluid chambers 33*a* and 33*b* into the reservoir portion 34 unseals the access opening 19 of the package 10.

In one embodiment of the invention, the reservoir portion 34 and the closure portion 36 of each of the fluid chambers 33*a* and 33*b* may each be at least partially filled with fluid. In this particular state, the access opening 19 may be partially unsealed or opened, which would allow a user or packager to deposit a product or good into the interior of the package 10. To seal the access opening 19, a user may exert a force upon the reservoir portion 34, such as by a squeezing motion, to move generally all of the fluid from the reservoir portion 34 into the closure portion 36 of each of the fluid chambers 33*a* and 33*b*. Further, a plurality of generally distinct chambers 33*a*, 33*b* or bubbles/tubes can be implemented to achieve such partial closure or opening such that the access opening is opened or closed in steps according to the number or size of the chambers 33*a*, 33*b*. Such an embodiment can provide a plurality of bubbles or chambers that can provide progressive or stepped inflation or deflation and, thus, progressive or stepped opening or closing of the package at the access opening 19. As illustrated in FIG. 3, when generally all of the fluid is disposed in the closure portions 36 they selectively block and positively seal the access opening 19. To facilitate closure, the closure portion 36 of each of the fluid chambers 33*a* and 33*b* does not necessarily need to be fully inflated to high volumes of pressure, as only enough pressure to seat or abut the chambers 33*a*, 33*b* against each other is necessary.

In another embodiment, the user may lightly pinch the end of the reservoir portion 34 that is near the side seal 18 between two fingers and slide the across the reservoir portion 34 towards the regulator 40, akin to a zipper-like action that one uses in sealing a zipper lock package. The action typically displaces the fluid from the reservoir portion 34 into the closure portion 36. Opening the closure portion 36 may be accomplished in the same manner by sliding a light pinching grip across the closure portion 36 to return the fluid to the reservoir portion 34.

In another embodiment, the fluid regulator 40 may be tailored to enable slow movement of fluid between the reservoir portion 34 and the closure portion 36 without application of force. That is, the fluid regulator 40 may be configured to effectively provide a slow leak therethrough even when no external force is applied to one of the reservoir portion 34 and the closure portion 36. An exemplary and non-limiting range of dimensions for the fluid actuated closure 30 that implements such a "slow pass" fluid regulator 40 may comprise the narrow channel 41 with a length 40.1 ranging from about 6-mm to about 50-mm (approximately ¼- to 2 inches) and the throat major dimension 40.2 ranging from about 2-mm to about 6-mm (approximately 1/16- to ¼-inch). Exemplary and non-limiting dimensions for the lengths 34.2 and 36.2 for the reservoir and closure portions 34, 36, respectively, may range from about 25- to 150-mm (approximately 1- to 6-inches), with heights 34.1 and 36.1 that may range from about 6- to 40-mm (approximately ¼- to ½-inches). To facilitate opening and closing the package 10 with a zipper-like action, narrower heights for the 34.1 and 36.1 dimensions (on the order of 6- to 10-mm) may be preferred.

In operation, consider the "slow pass" fluid regulator 40 with, for example, a volume of air that has been manipulated to reside primarily in the reservoir portion 34. The presence of more air in the reservoir portion 34 may cause the air therein to expand against the wall of the reservoir portion 34 and thus be at a higher pressure than the air remaining within the closure portion 36. The bulk of the higher pressure air in the reservoir portion 34 may remain therein for a period long enough to enable a user to remove product from the flexible container 10 through the access opening 19 of the closure portion 36. Thereafter, the pressure difference between the reservoir portion 34 and the closure portion 36 may slowly migrate back into the closure portion 36 as the two chambers 34 and 36 approach equalization. For an air volume that is properly sized, the closure portion 36 will be closed as the pressures approach equalization. In some embodiments, the pressure between the closure portion 36 and the reservoir portion 34 may not reach equalization but still function to effectively contain the product.

By this mechanism, the "slow pass" fluid regulator 40 essentially closes automatically over a period of time, thereby retaining product freshness should the user forget to reseal the bag. It is understood that the gradual migration between the reservoir portion 34 and the closure portion 36 may be overridden for a more rapid sealing by application of an external force, as described above.

Figure 4:
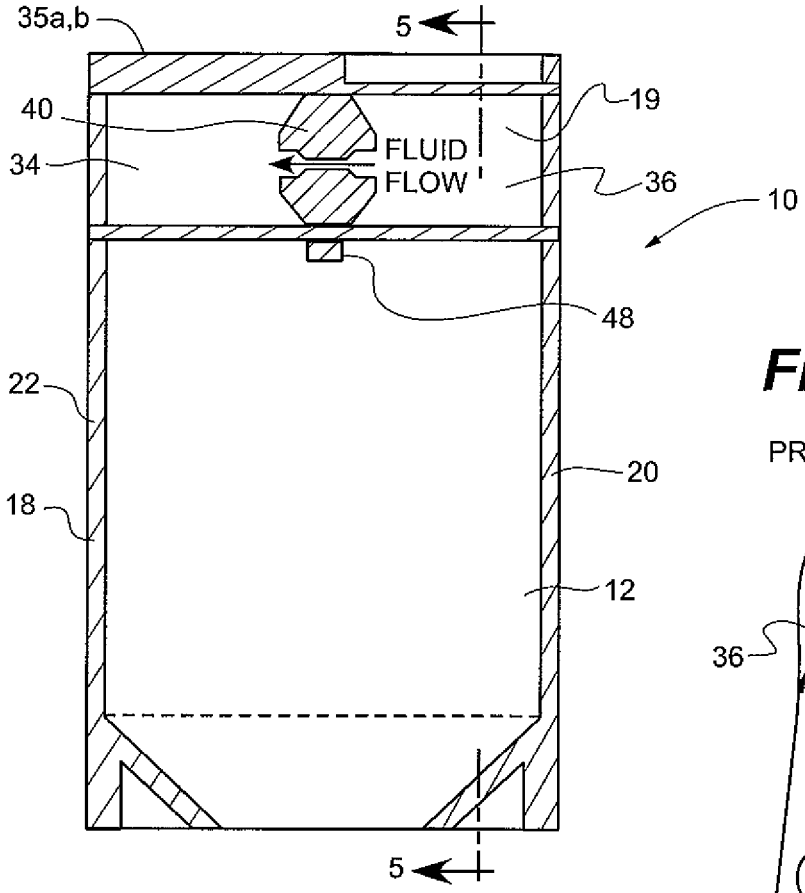
FIG. 4 is a front view of one embodiment of a flexible package having the fluid actuated closure without a top seal.
Figure 5:
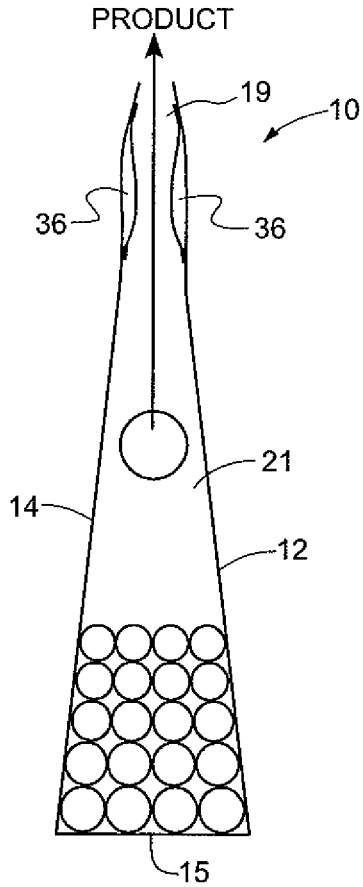
FIG. 5 is cross-section view of the embodiment of FIG. 4 with the fluid actuated closure in an opened or deflated state.
Figure 6:
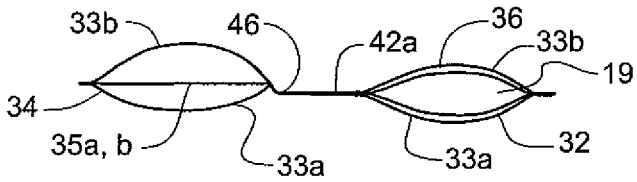
FIG. 6 is a top view of the embodiment of FIG. 3 having a fluid actuated closure mechanism in an opened or deflated state.

To access the interior of the package 10 a user needs to move the fluid from the closure portion 36 of each of the fluid chambers 33*a* and 33*b* into the reservoir portion 34. To move the fluid from the closure portion 36 to the reservoir portion 34 a user exerts a force upon the closure portion 36 of each of the fluid chambers 33*a* and 33*b*, such as by a squeezing motion. As illustrated in FIGS. 4-6, the closure portion 36 of each of the fluid chambers 33*a* and 33*b* begin to deflate as the fluid flows through the regulator 40 and into the reservoir portion 34. When the closure portion 36 of each of the fluid chambers 33*a* and 33*b* are deflated the access opening 19 is unsealed and the contents of the package 10 are accessible. The contents of the package may include solid or fluid product.

Figure 7:
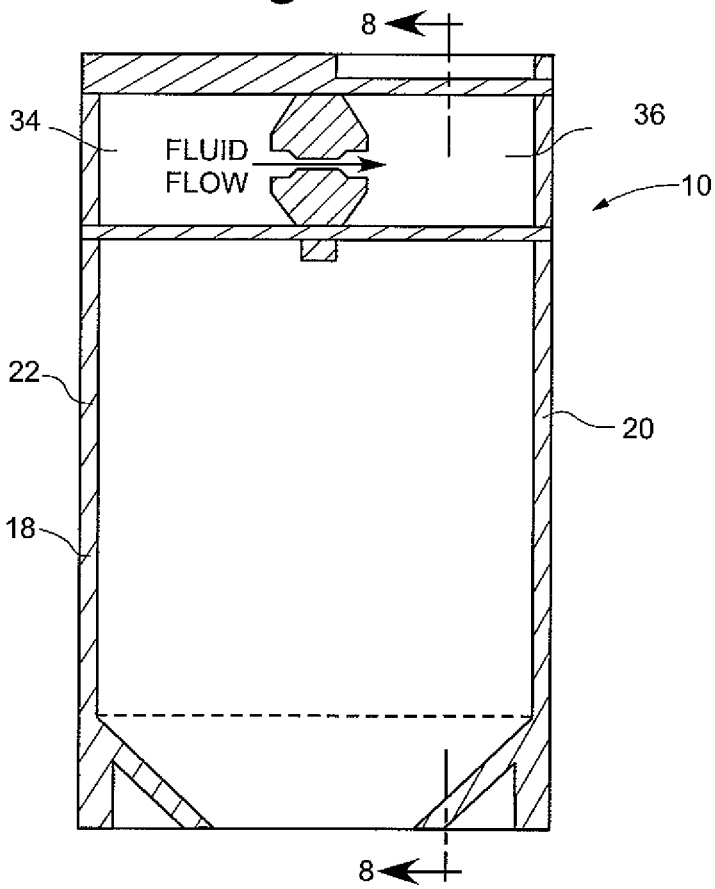
FIG. 7 is a front view of one embodiment of a flexible package with the fluid actuated closure in a closed position.
Figure 8:
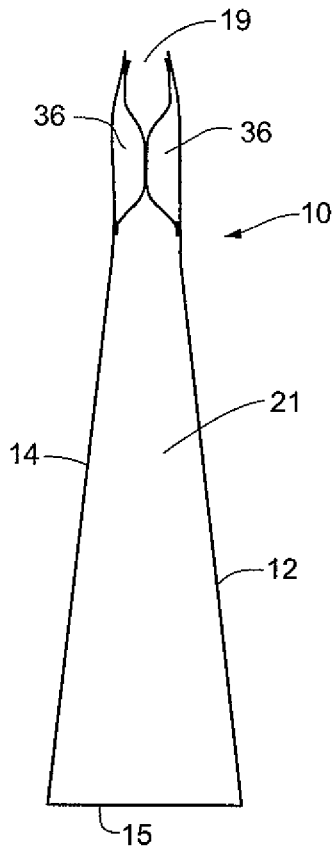
FIG. 8 is a cross-section view of the embodiment of FIG. 7 illustrating the fluid actuated closure in a closed or inflated state.
Figure 9:
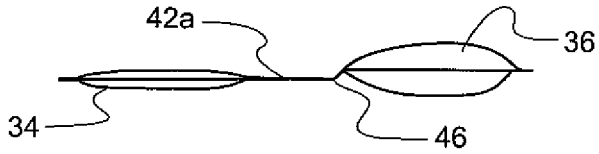
FIG. 9 is a top view of one embodiment of a flexible package having a fluid actuated closure in a closed position.

As illustrated in FIGS. 7-9, the package 10 may be resealed by squeezing the reservoir portion 34 at the top of the package 10, which causes the fluid to flow through the fluid regulator 40 and into the closure portion 36 of each of the fluid chambers 33*a* and 33*b*. As illustrated in FIGS. 8 and 9, as the closure portion 36 of each of the fluid chambers 33*a* and 33*b* fill or inflate the first 32*a* and second 32*b* barrier films between the front 12 and back 14 panels begin to compress and conform to each other, leaving no gaps, or substantially no gaps, for oxygen or liquid to pass or escape between them. This barrier feature is enhanced by the abutting nature of the chambers 33*a*, 33*b* and/or the material construction of the chambers (e.g., laminate or other material having oxygen barrier properties). The content of the package 10 can be kept fresher, for longer periods of time; even after the package 10 has been initially opened by the user. Materials and films having such barrier protective properties are known in the art and are envisioned for implementation with the present invention.

In one embodiment of the invention, at least one of the first 32*a* and second 32*b* barrier films, or the material defining the fluid regulator 40, can be made from a material having a high surface energy or static charge, such as saran polyvinylidene chloride or other like films and materials that have a tendency to adhere and/or cling to themselves or other objects. As such, the opposing chambers 33*a*, 33*b* are generally drawn in together when proximately positioned. In this embodiment, the combination of the inflation of the closure portion 36 of the fluid chambers 33*a* and 33*b* and the increased adherability and/or cingability of the first 32*a* and second 32*b* barrier films ensures positive sealing of the package 10 when an object is disposed generally between the inflated closure portion 36 of the fluid chambers 33*a* and 33*b*. In another embodiment, the chambers can simply be strips 33*c*, 33*d* of such high energy material (not necessarily forming a chamber or tube) such that each strip 33*c*, 33*d* tend to cling or attract towards one another to provide a cling seal to provide for selective access into the package 10 and its contents. As such, the strips 33*c*, 33*d* draw toward one another to provide the seal, but can be easily removed or separated to provide access to the inner cavity 21. These strips 33*c*, 33*d* can run across the entire length of the top of the package 10, or just along a portion of the package 10 proximate the access opening 19. Other embodiments can utilize adhesives or other means of drawing or adhering the films or chambers together.

Figure 10:
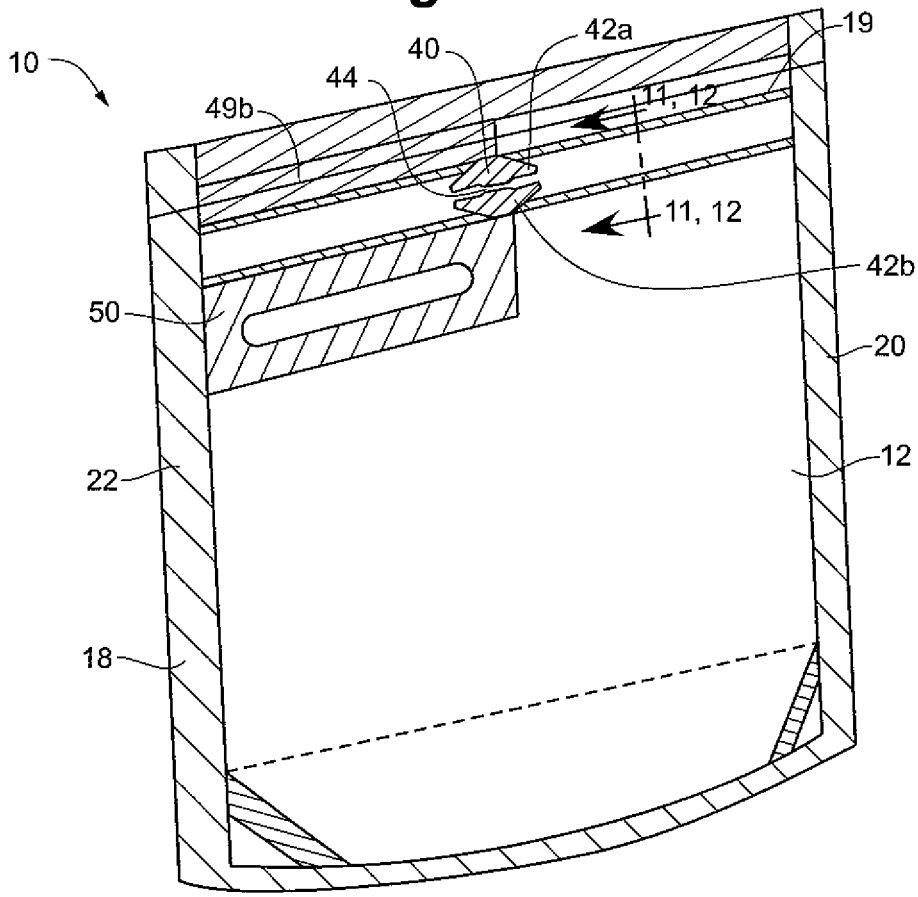
FIG. 10 is a front view of one embodiment of a flexible package having an integrated handle for carrying the package and a fluid regulator.
Figure 11:
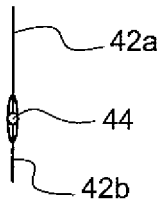
FIG. 11 is a cross-section view of FIG. 10 illustrating an embodiment of the fluid regulator in a closed position.
Figure 12:
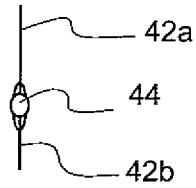
FIG. 12 is a cross-section view of FIG. 10 illustrating an embodiment of the fluid regulator in an open position.
Figure 13:
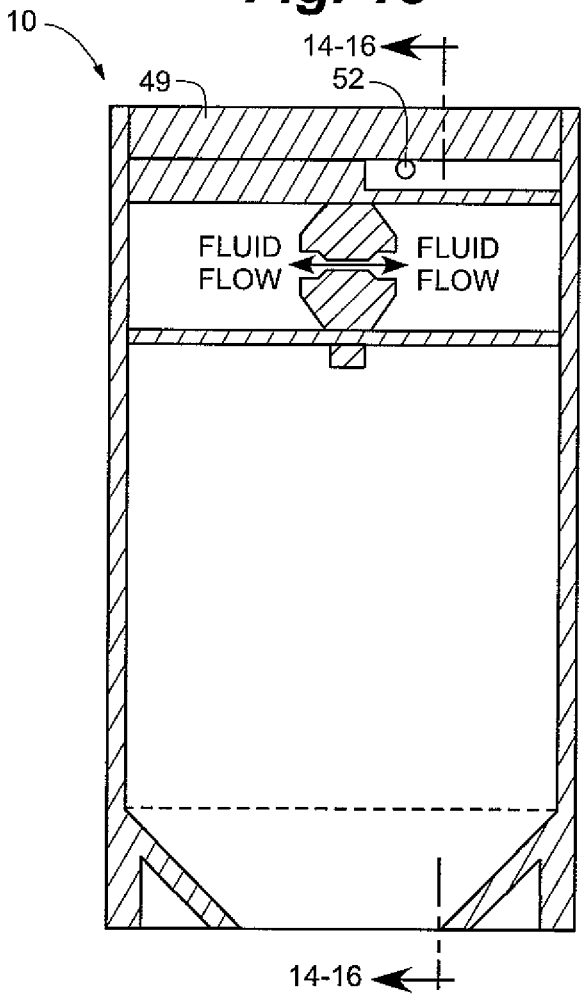
FIG. 13 is a front view of one embodiment of a flexible package having a fluid actuated closure and pressure outlet or vent.
Figure 14:
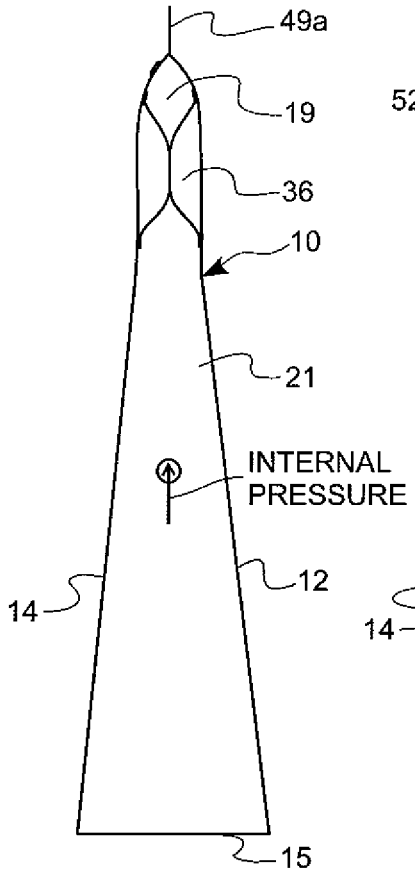
FIG. 14 is a cross-section view of FIG. 13 illustrating a generally higher internal pressure relative to an external pressure.

Referring to FIGS. 10-12, the fluid regulator 40 of each of the fluid chambers 33*a* and 33*b* may be disposed approximately halfway between each side of the package 10, although any percentage or distance across the package 10 is envisioned as long as there are sufficient air/bubble areas for the closure portion 36 and the reservoir portion 34. In one embodiment of the invention, as illustrated in FIGS. 11 and 12, the fluid regulator 40 may be formed by creating a partial sealed area or areas 42*a* and/or 42*b* generally across or along each of the fluid chambers 33*a* and 33*b*. As illustrated in FIGS. 11 and 12, a fluid restriction channel 44 may be formed between the partial sealed areas 42*a* and 42*b*. The fluid restriction channel 44 may have a generally constricted state, as illustrated in FIG. 11, such that fluid is not permitted to flow through without the application of a force (manual, mechanical, etc.) on the inflated reservoir portions 34 or closure portions 36. Upon the application of a force, or other means of moving the fluid, the fluid restriction channel 44 may expand or open to permit the fluid to flow, as shown in FIG. 12. The partially sealed area or areas 42*a* and/or 42*b* may be of any shape and size which selectively restricts the flow of fluid between the reservoir portion 34 and the closure portions 36 of the fluid chambers 33*a* and 33*b*. Other types of valves and fluid regulating mechanisms known to one skilled in the art may also be utilized to regulate the flow of fluid between the chambers or package portions.

In an embodiment of the invention, as illustrated in FIGS. 6 and 9, fluid movement between the reservoir portion 34 and the closure portion 36 may be restricted by creating a kink or bend 46 in the fluid chambers 33*a* and 33*b*. In an example embodiment, the kink 46 is formed when the fluid in one fluid chamber 33*a* or 33*b* is greater than the other. The fluid in the opposing fluid chamber 33*a* or 33*b* causes the fluid chamber 33*a* or 33*b* with more fluid to push further against the fluid chamber with less fluid, causing the kink 46 and restricting fluid flow across the portions 34, 36. In another embodiment, the fluid restriction channel 44 and kink 46 may be utilized together to ensure restriction of a flow of fluid between the reservoir portion 34 and the closure portion 36 of the fluid chambers 33*a* and 33*b*.

An intermediate seal 48 may be made just above and potentially just under the kink 46 and/or fluid restriction channel 44 in the fluid chambers 33*a* and 33*b*, as shown in FIG. 4. The intermediate seal 48 will seal the front 12 and back 14 panels of the package 10 together and ensure that they cannot separate except where the fluid closure portions 36 of the fluid chambers 33*a* and 33*b* permit upon fluid movement. Furthermore, the intermediate seal 48 may be a dividing point between a side of the package 10 that will be accessible to the product, and a non-accessible side. The fluid restriction channel 44 and the fluid closure portion 36 of each of the fluid chambers 33*a* and 33*b* can be different sizes and shapes to fit the particular needs and functions of the package size and shape being used for a particular product.

Referring to FIGS. 2-3, and 13-16, a top seal 49*a* may be formed in the front 12 and back 14 panel portions (generally after packaging of the product/contents) to seal the access opening 19 of the package 10. A perforation, laser score, or tear line 49*b* may be formed or identified along a length of the top seal 49*a* to permit a user to easily remove or tear open the top seal and access the interior of the package 10 through the access opening 19. Other forms of sealing, such as peal and seal closures, slits, perforations, and the like can be incorporated with the package 10 and its inventive fluid actuated closure.

In one embodiment of the invention, as illustrated in FIG. 10, a carrying device or handle 50 may be joined to or formed on the package 10. The handle 50 may be disposed or sealed generally adjacent to at least one of the fluid chambers 33*a* and 33*b* and may have a planar surface generally parallel to the front 12 and/or back 14 panels. During use, the handle 50 may be folded generally upward for carrying the package. The handle 50 may be any size and shape. Additionally, the handle 50 may be made of multiples layers or a barrier material similar to other portions of the package 10 to add additional strength and reinforcement. This design also allows the handle to remain on the package after the consumer removes the top seal 49*a* to access the product.

Figure 15:
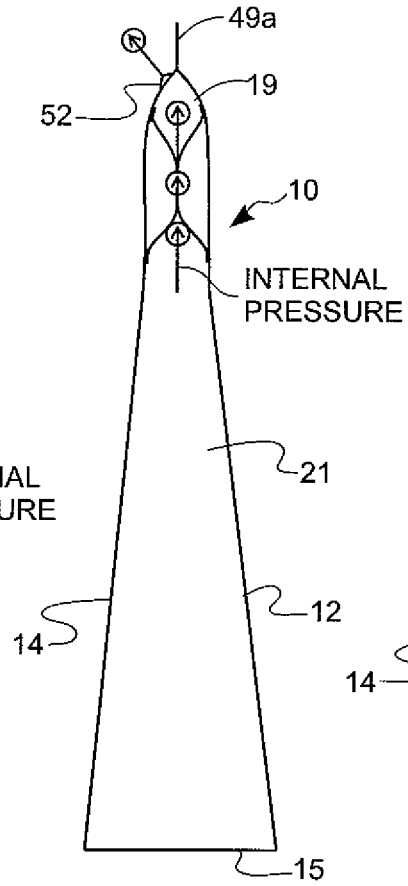
FIG. 15 is a cross-section view of FIG. 13 illustrating an escaping internal pressure through the fluid actuated closure and the pressure outlet or vent.
Figure 16:
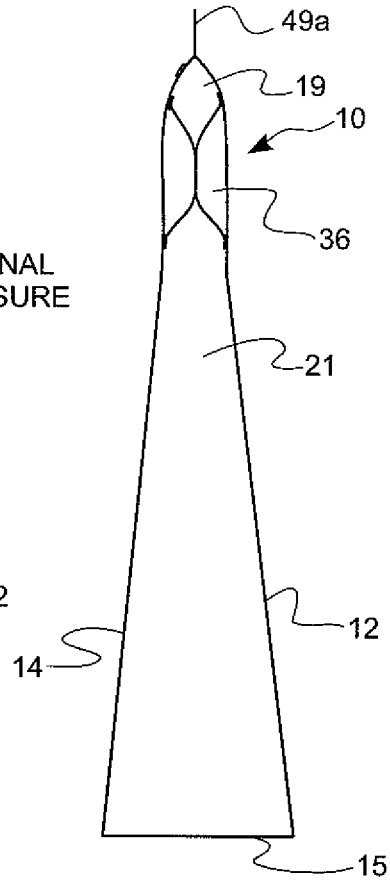
FIG. 16 is a cross-section view of FIG. 13 illustrating a resealing or reseating of the fluid actuated closure upon equalization of the internal and external pressure.
Figure 17:
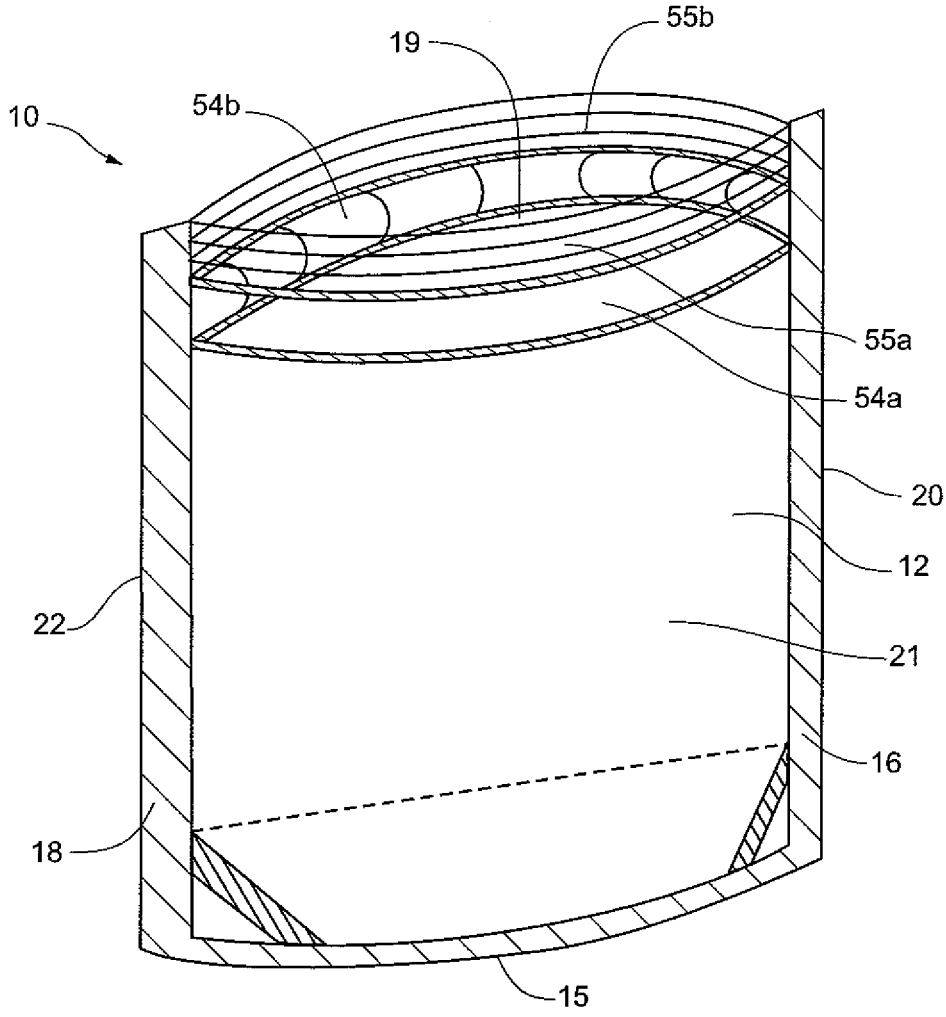
FIG. 17 is a perspective view of a package with fluid-filled chambers for sealing and a closure mechanism above the fluid-filled chambers in an embodiment of the invention.
Figure 18:
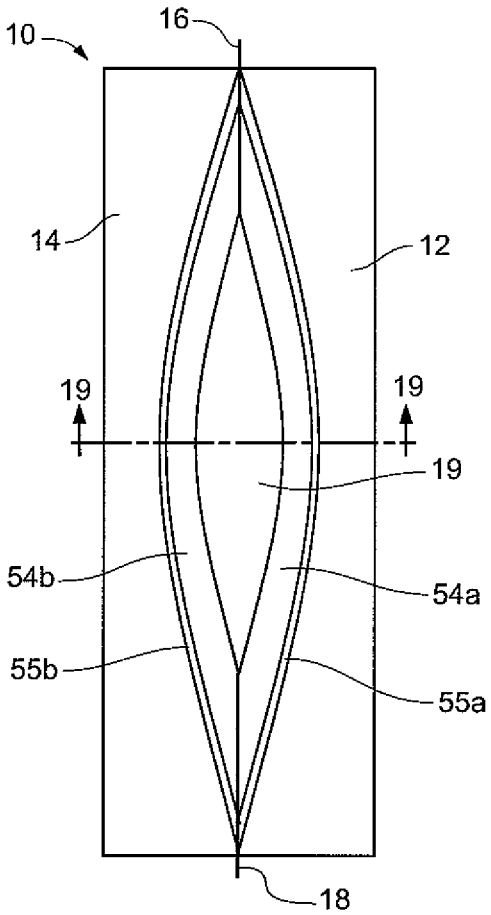
FIG. 18 is a top view of the package of FIG. 17 in an open position.
Figure 19:
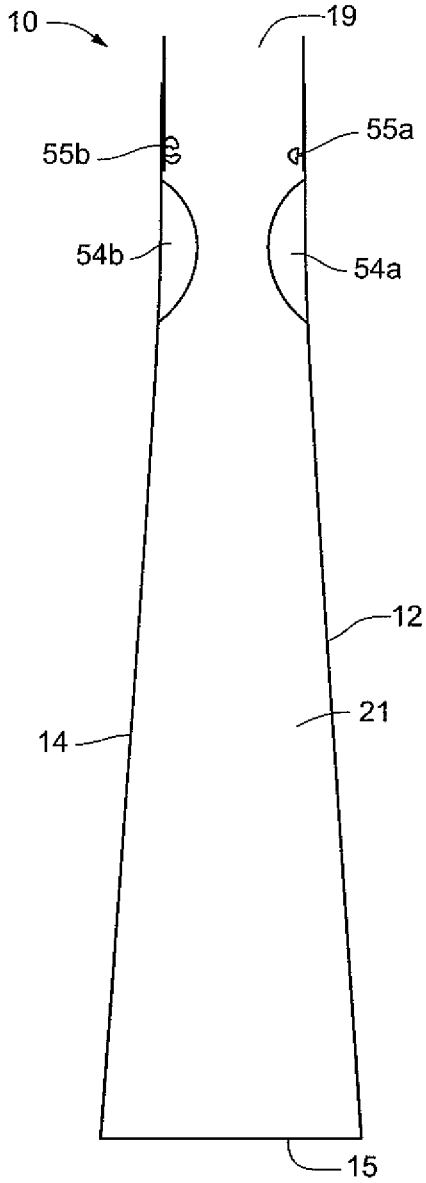
FIG. 19 is a cross-section view of the package of FIG. 18.
Figure 20:
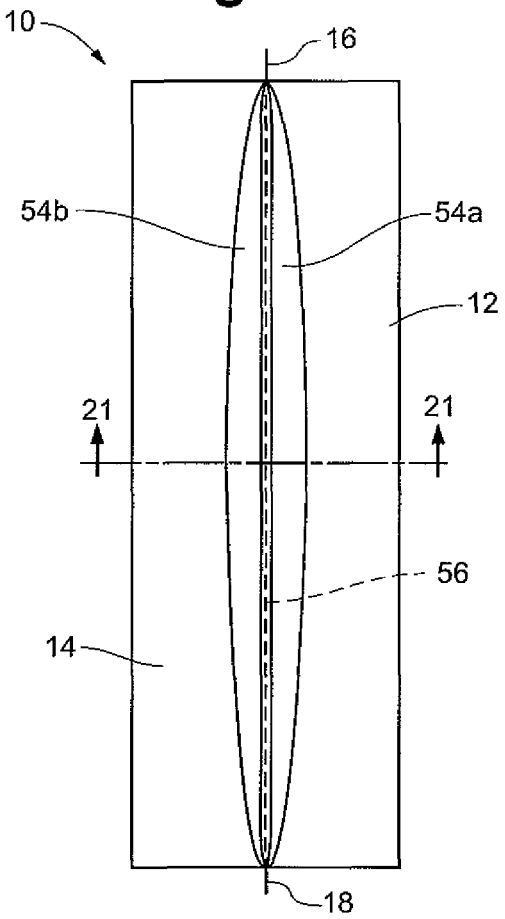
FIG. 20 is a top view of the package of FIG. 17 in a closed position.
Figure 21:
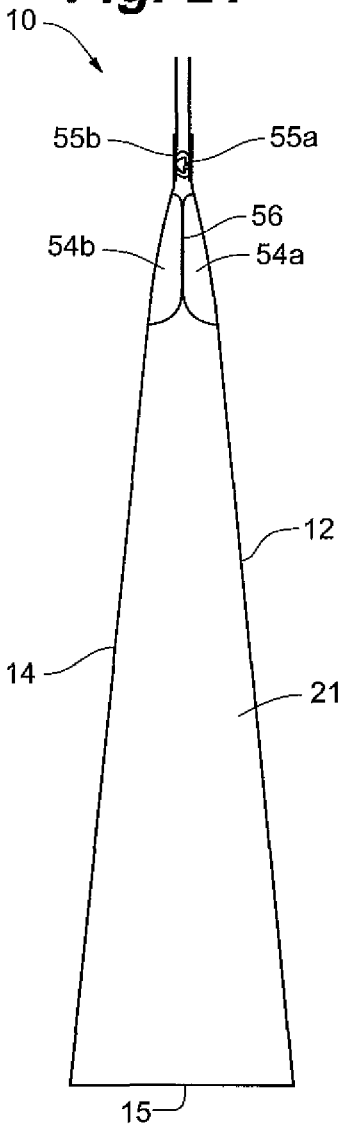
FIG. 21 is a cross-section view the package of FIG. 20.

In another embodiment of the invention, as illustrated in FIGS. 13-16, a portion of the front 12 or back 14 panels may include an outlet or aperture 52 to permit a gas in the package 10 to escape. When the closure portion 36 of the fluid chambers 33*a* and 33*b* are inflated, they can act as a release valve for internal products which produce a build up of gas or vapors (e.g. packaged coffee), keeping the package 10 from rupturing while preventing oxygen from outside the package 10 from getting in. As illustrated in FIG. 15, as the gas or vapor builds in the package 10, depending on the material makeup of the chambers 33*a*, 33*b* or the closure portion 36, it will be able to force its way between the two opposing closure portions 36 and escape through the outlet 52. As illustrated in FIG. 16, once the pressure created by the gas or vapor has been released, the closure portions 36 of each of the fluid chambers 33*a* and 33*b* can re-seat against one another, keeping any unwanted oxygen or other fluids from entering the package 10 through the access opening 19.

In other embodiments of the invention, the fluid chambers 33*a* and 33*b* can include a series of smaller fluid chambers or bubbles, long skinny rows of bubbles, or shaped bubbles that compress and or interlock/nest against each other. Depending on the access opening 19 size, and the degree or progressive nature of the closure, different bubble shapes and configurations can be employed.

Although the descriptions noted above are typically for pre-made package formats, it is also envisioned that someone skilled in the art could use this same method on form, fill, and seal machinery, or other packaging machines known to one of ordinary skill in the art. This closure method can be used on virtually any style package; including side gusseted packages, or other packages with transversely applied access devices, tie slits, discrete compartments, and the like. Examples of such packages are taught in U.S. patent application Ser. Nos. 10/396,295, 10/456,971 and 10/954,153, which are co-pending applications of the Applicant and are hereby incorporated by reference in their entirety herein. The tubes/chambers taught herein are generally envisioned for implementation during the manufacturing or forming of the package and/or during the packaging of the product. However, it is also envisioned that they could be preformed and introduced into the package during the manufacturing of the package and/or during the filling of the product into the package. The fluid chambers 33*a* and 33*b* or tubes can be preformed and/or pre-filled with air and could be pre-applied to the main package web or material either along or transversely to a machining or web direction of the package. In addition, the reservoir portions 34 and closure portions 36 can be provided along the side of the package, the bottom, the top, or a combination thereof. For instance, the reservoir portion 34 could be position along the side of the package proximate the longitudinal edges 20, 24, while the access opening 19 remains proximate the top of the package. Other variations and selective positioning for the portions 34, 36 are envisioned as well.

In one embodiment, the package 10 can include a pinching or closing-off device (not shown) positioned internally or externally to the package 10 to close off the fluid regulator 40 or its channel 44. Such a device can prevent fluid transfer between the reservoir 34 and closure 36 portions and can be actuated, engaged or otherwise utilized when it is necessary to prevent such fluid transfer during shipment, storage, use, etc. If, for instance, pressure is applied to the package 10 or its portions 34, 36 during shipment or storage, the fluid transfer will be restricted, thus preventing inadvertent opening of the package at the access opening 19. One exemplary embodiment includes an external clip device that will pinch the regulator channel 44 to close off fluid communication between the portions 34, 36 of the chambers 33*a*, 33*b*.

Additionally, various handles, valve devices, graphics or indicia, closeable and re-closeable devices, gusseted panels or portions, and like features or devices known to one skilled in the art are also envisioned for use with this invention and can be implemented without deviating from the spirit and scope of the present invention. All references to front, back, bottom, and the like are merely for demonstrative purposes and are not intended to limit the variations and positional references and orientations of the panels or the fluid actuated closure of the present invention.

Referring to FIGS. 17-21, the package 10 is depicted in an embodiment of the invention that includes a pair of fluid-filled chambers 54*a*, 54*b* proximate the opening 19. The fluid-filled chambers 54*a*, 54*b* and the opening 19 may extend essentially the width of the package 10 or opening 19. In one embodiment, the fluid-filled chambers 54*a*, 54*b* are located on opposite front and back panels 12 and 14, respectively, at substantially the same elevation. Interlocking members 55*a* and 55*b* are disposed on the front and back panels 12 and 14, respectively, just above the fluid filled chambers 54*a* and 54*b*. The interlocking members 55*a* and 55*b* may be a zipper closure, such as disclosed in U.S. Pat. No. 6,376,035 to Dobreski et al., the disclosure of which is hereby incorporated by reference except for terms expressly defined therein. Other fastening means that could be utilized include a press-to-close mechanism, such as disclosed in U.S. Pat. No. 4,703,518 to Ausnit, the disclosure of which is hereby incorporated by reference except for terms expressly defined therein.

The fluid-filled chambers 54*a* and 54*b* may be constructed of a suitable thin-walled elastic film known for retention or low permeability of gas, such as a polyethylene, a polyethylene/ethylene vinyl alcohol copolymer or other suitable polymers.

In operation, the package is closed by joining interlocking members 55*a* and 55*b*, which also causes chambers 54*a* and 54*b* to contact each other and form an interface area 56 that extends the width of the package 10 or opening 19. The holding force of the interlocking members 55*a* and 55*b* causes a pressure at the interface area 56 to positively seal the inner cavity 21. By this arrangement, the package 10 is sealed not only by the closure of the interlocking members 55*a* and 55*b*, but additionally by the contact between the fluid-filled chambers 54*a* and 54*b* which may enhance the integrity of the closure.

Figure 22:
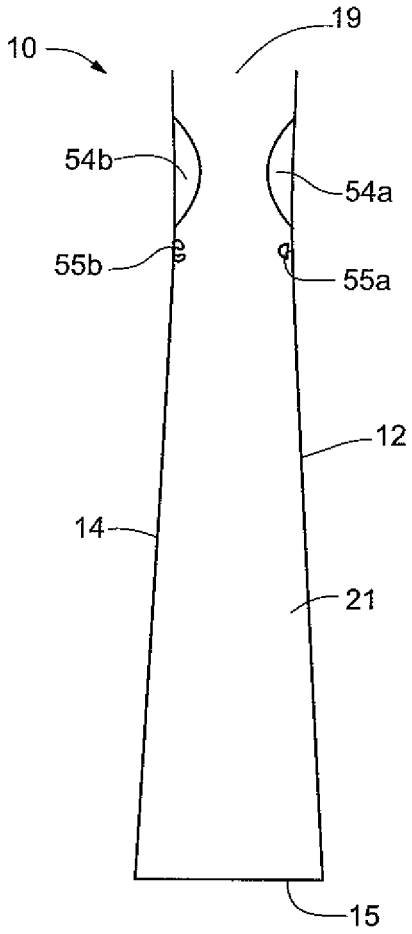
FIG. 22 is a cross-section view of a package in an open position with fluid-filled chambers for sealing and a closure mechanism below the fluid-filled chambers in an embodiment of the invention.
Figure 23:
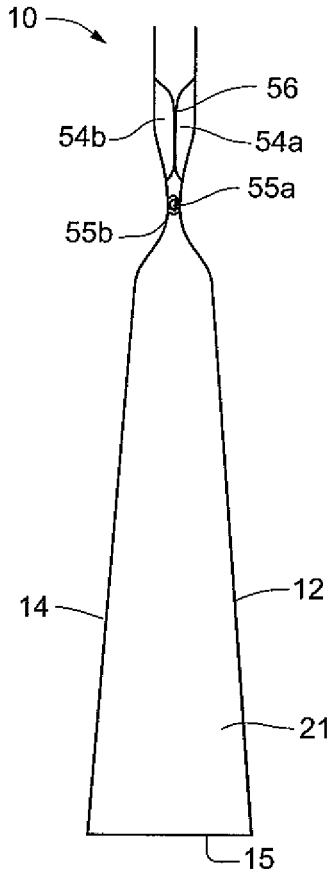
FIG. 23 is a cross-section view of the package of FIG. 22 in the closed position.

Referring to FIGS. 22 and 23, the package 10 is depicted in another embodiment of the invention. This embodiment can have all of the same components and operational aspects as the embodiment of FIGS. 17-20, but differs in the orientation of the interlocking members 55*a* and 55*b* relative to the fluid-filled chambers 54*a* and 54*b*. Here, the interlocking members 55*a* and 55*b* are located on the interior side of the interface area 56. Accordingly, the interlocking members 55*a* and 55*b* may form the primary seal, with the interface area 56 constituting a backup or secondary seal.

Figure 24:
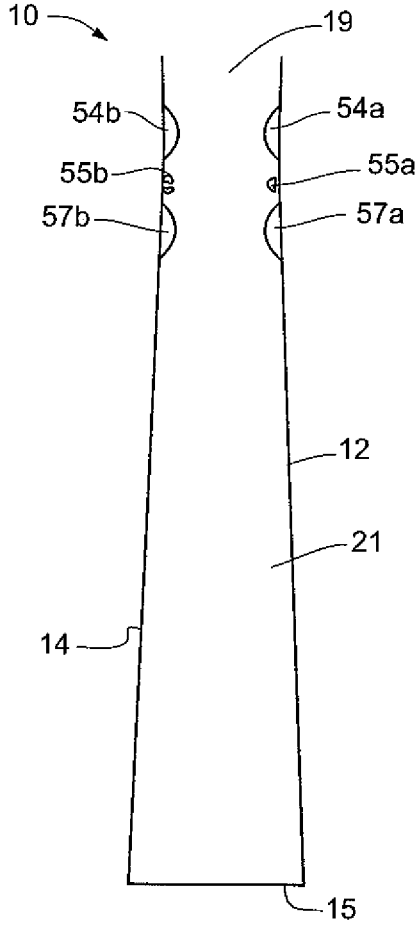
FIG. 24 is a cross-section view of a package in an open position with parallel pairs of fluid-filled chambers and a closure mechanism disposed between the parallel pairs of fluid-filled chambers for sealing in an embodiment of the invention.
Figure 25:
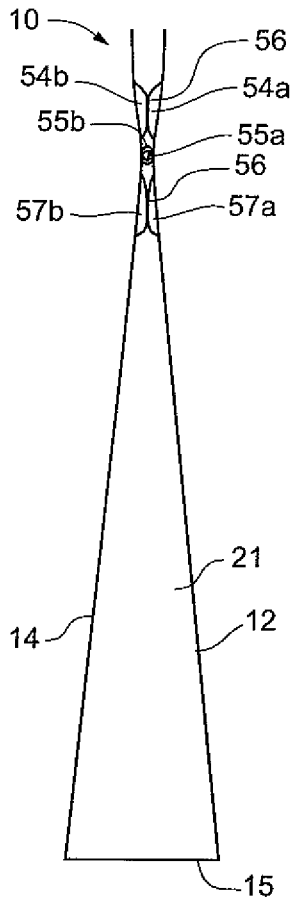
FIG. 25 is a cross-section view of the package of FIG. 24 in the closed position.
Figure 26:
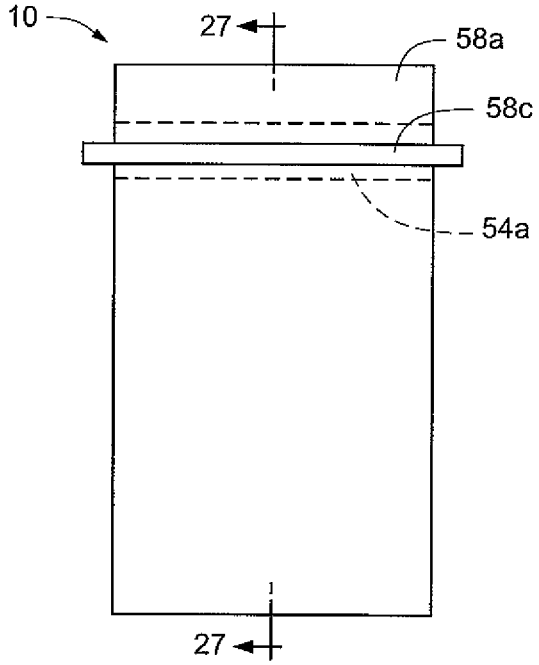
FIG. 26 is a front elevation view of a package having a tin-tie closure in an open position with fluid-filled chambers for sealing in an embodiment of the invention.
Figure 27:
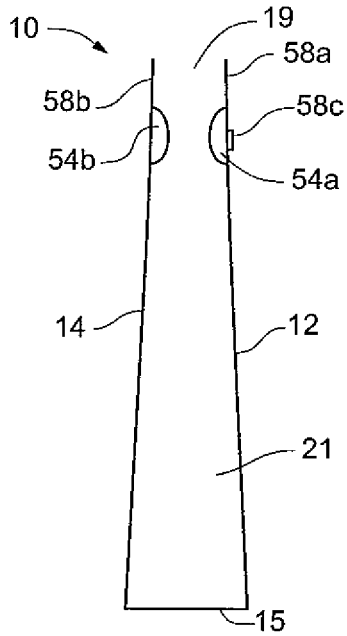
FIG. 27 is a cross-section view of the package of FIG. 26.
Figure 28:
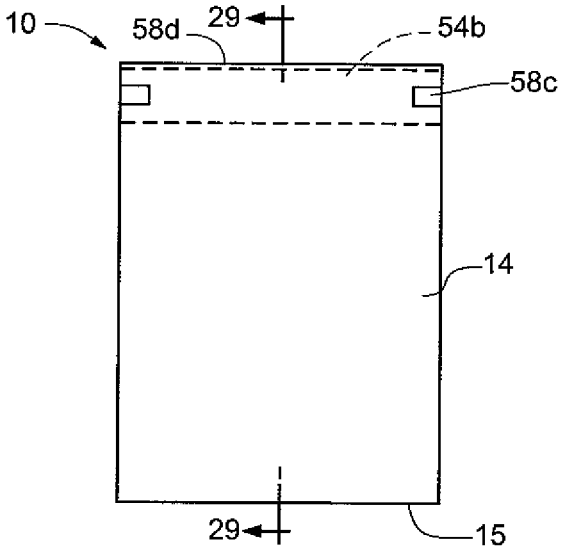
FIG. 28 is a front elevation view of the package of FIG. 26 in a closed position.
Figure 29:
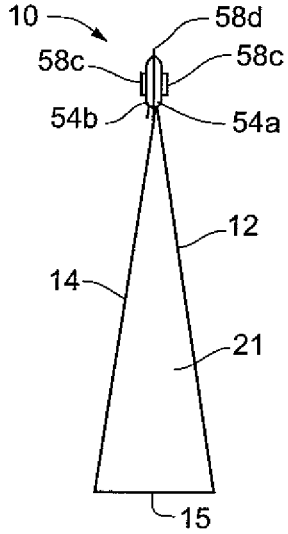
FIG. 29 is a cross-section view of the package of FIG. 28.

Referring to FIGS. 24 and 25, another embodiment of the package 10 with contacting fluid-filled chambers is depicted. In this embodiment, the interlocking member 55*a* is disposed on an interior portion of front panel 12 between two distinct fluid-filled chambers 54*a* and 57*a*, and interlocking member 55*b* is disposed on an interior portion of the back panel 14 between two distinct fluid-filled chambers 54*b* and 57*b*. In this embodiment, the coupling of the interlocking members 55*a* and 55*b* holds the two pairs of chambers 54*a*, 54*b* and 57*a*, 57*b* in contact to form two interface areas 56. In this way, the sealing area may be doubled or otherwise increased.

Referring to FIGS. 26-29, the package 10 is depicted using a tin-tie closure to hold chambers 54*a* and 54*b* in contact in an embodiment of the invention. The tin-tie closure can be of any such device known to a skilled artisan. A pair of flap portions 58*a* and 58*b* extend upward from the front and back panels 12 and 14, respectively and above the fluid-filled chambers 54*a* and 54*b*. A tin-tie 58*c* having ends that extend beyond the width of the package 10 in both directions may be disposed on an outer surface of the front panel 12 adjacent the chamber 54*a*.

In operation, the package 10 is closed by pressing the flap portions 58*a* and 58*b* together and folding them downward to form a crease or bend 58*d* that runs the width of the package 10. The flap portions 58*a* and 58*b* are held in the creased positions by folding the ends of the tin-tie 58*c* over the folded flap portions 58*a* and 58*b* or over or around the package. The chambers 54*a* and 54*b* may be held in contact by the crease 58*d* and retention applied by the force of the tin-tie.

In the above-described embodiments depicted in FIGS. 17-29, the interlocking members 55*a* and 55*b* need not provide sealing for the package 10. Rather, the integrity of the seal can be maintained by the various fluid-filled chambers 54*a*, 54*b* and/or 57*a*, 57*b*. The interlocking members 55*a* and 55*b* need only function to hold the fluid-filled chambers 54*a*, 54*b* and/or 57*a*, 57*b* in contact. Accordingly, the package 10 may continue to function properly even if the interlocking members 55*a*, 55*b* become damaged or become plastically deformed from repeated operation.

Figure 30:
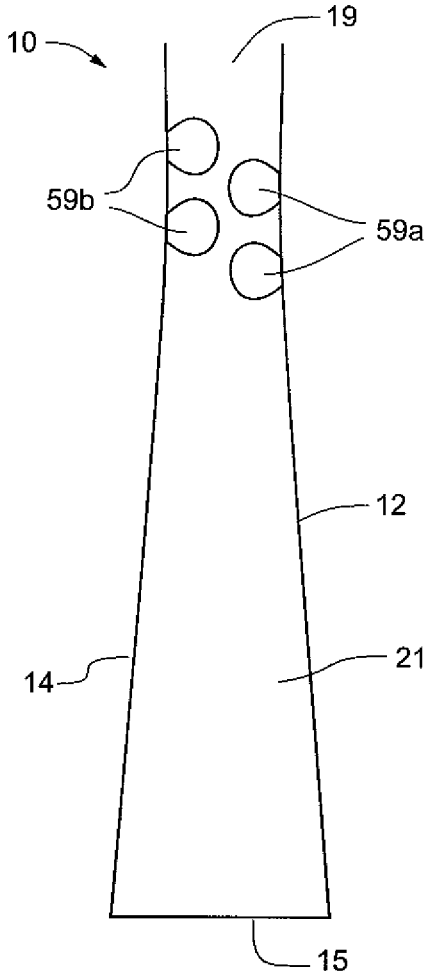
FIG. 30 is a cross-section view of a package in an open position with fluid-filled chambers that interlock for sealing in an embodiment of the invention.
Figure 31:
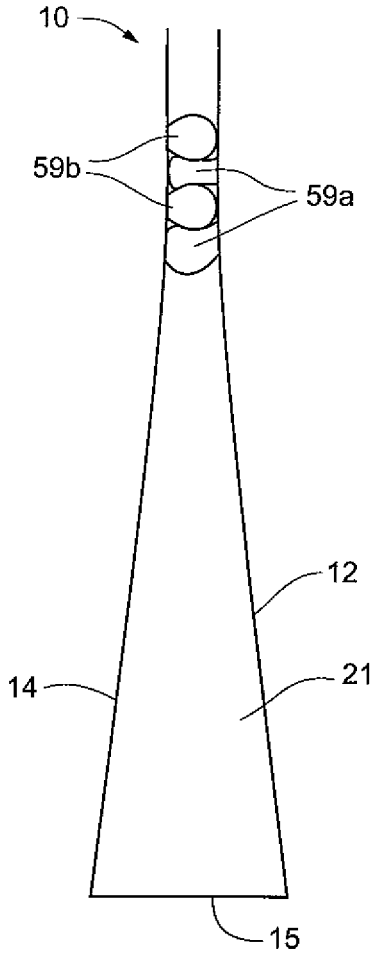
FIG. 31 is a cross-section view of the package of FIG. 30 in a closed position.

Referring to FIGS. 30 and 31, a package 10 including fluid-filled chambers 59*a* and 59*b* that interlock is depicted in an embodiment of the invention. Here, a plurality of distinct fluid-filled chambers 59*a* are formed on the front panel 12 and a plurality of distinct fluid-filled chambers 59*b* are formed on the back panel 14. The fluid-filled chambers 59*a*, 59*b* are shaped and positioned so that when the opening 19 is closed, the fluid-filled chambers 59*a*, 59*b* interlock. These chambers 59*a*, 59*b* can be taut or substantially filled with fluid to provide a semi-rigid or firm structure for interlocking. In a further embodiment, at least one of the chambers 59*a*, 59*b* may be replaced with a solid member (not depicted) shaped to engage with the opposing fluid-filled chamber and effect a seal. The solid member may be of a rigid or a flexible material.

Functionally, the interlocking of the fluid-filled chambers 59*a*, 59*b* serves to hold the fluid-filled chambers 59*a*, 59*b* in contact and thereby seal the package 10. In this embodiment, no additional structure is required to hold the fluid-filled chambers 59*a*, 59*b* in contact and maintain the seal. However, such closure structures as described herein could be implemented to further secure the contents of the package 10. For example, fastening means may be situated both above and below the fluid-filled chambers 59*a*, 59*b* to provide additional security while maintaining a symmetrical force on the interlocking fluid-filled chambers 59*a*, 59*b* (not depicted).

The embodiment of FIGS. 30 and 31 portrays two fluid-filled chambers on each of the opposing panels. The interlocking function may instead be affected by two fluid filled chambers on one panel (e.g. two fluid-filled chambers 59*a*) and one on the opposite panel that slips therebetween (e.g. only the lower fluid-filled chamber 59*b*). Likewise, the interlocking function may be affected by more than two fluid-filled chambers on each panel.

Figure 32:
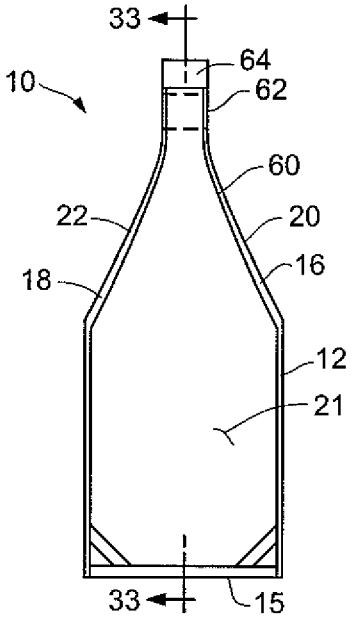
FIG. 32 is a front elevation view of a package with fluid-filled chambers that seal the throat of a funnel portion in an embodiment of the invention.
Figure 33:
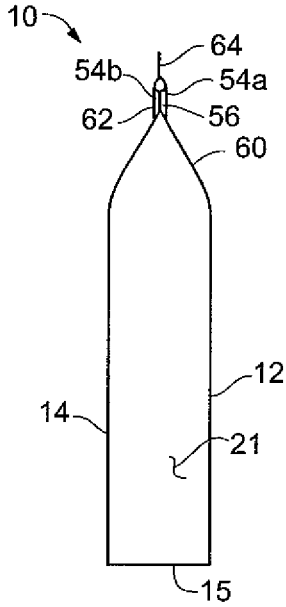
FIG. 33 is a cross-section view of the package of FIG. 32.
Figure 34:
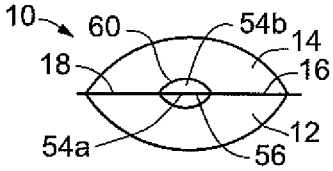
FIG. 34 is a top view of the package of FIG. 32.

Referring to FIGS. 32-34, the package 10 having a funnel or necking portion 60 is depicted in an embodiment of the invention. In the depicted embodiment, the necking portion 60 is defined by longitudinal edges 20, 22 and edge seals 16, 18 that converge to define a throat portion 62. The throat portion 62 includes the fluid-filled chambers 54*a* and 54*b* to form the interface area 56 therebetween. The fluid-filled chambers 54*a* and 54*b* may be integrally formed with and held in sealing contact by the throat portion 62.

Figure 33A:
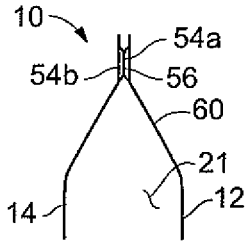
FIG. 33*a* is a partial cross-section view of the package of FIG. 32 with the top seal removed.
Figure 33B:
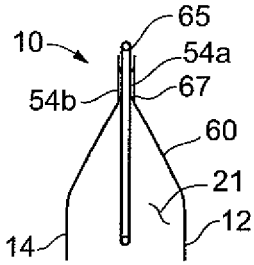
FIG. 33*b* is the partial cross-section view of FIG. 35 with a straw inserted.

A top seal 64 may be integrally formed with side seals 16 and 18 to initially seal the package 10. The top seal 64 (FIG. 33) may be removed by tearing or cutting. A conduit 65 such as a straw or tube may be inserted between the fluid-filled chambers 54*a* and 54*b* (FIG. 33*b*). When the opposing fluid-filled chambers 54*a* and 54*b* are utilized, the interface area 56 of the package 10 can serve to regulate or control the flow or exit of the contents from the package 10. Control of the flow may be accomplished by squeezing a portion of the package to force the contents (e.g. a fluid) through the interface area 56. The conduit 65 passing through the interface area 56 can further facilitate this regulation or access.

Figure 35A:
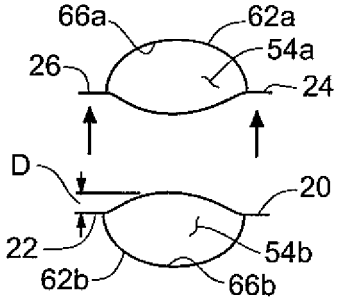
FIG. 35*a* is an exploded isolated view of a throat portion of a package in an embodiment of the invention.
Figure 35B:
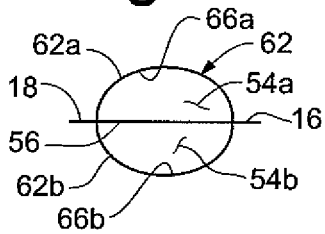
FIG. 35*b* is a view of an assembled throat portion of FIG. 35*a;*

Referring to FIGS. 35*a* and 35*b*, the throat portion 62 may be formed from two halves 62*a* and 62*b* that define recesses 66*a* and 66*b*, respectively. The fluid-filled chambers 54*a* and 54*b* are operatively coupled with the respective halves 62*a* and 62*b* of the throat portion 62. The fluid-filled chambers 54*a* and 54*b* may be sized to protrude away from the respective recesses 66*a* and 66*b* at a distance D (FIG. 35*a*). Upon joining the first and second front longitudinal edges 20 and 22 to the first and second back longitudinal edges 24 and 26 to form seams 16 and 18, the fluid-filled chambers 54*a* and 54*b* are compressed into the recesses 66*a* and 66*b* of halves 62*a* and 62*b* (FIG. 35*b*).

Figure 36:
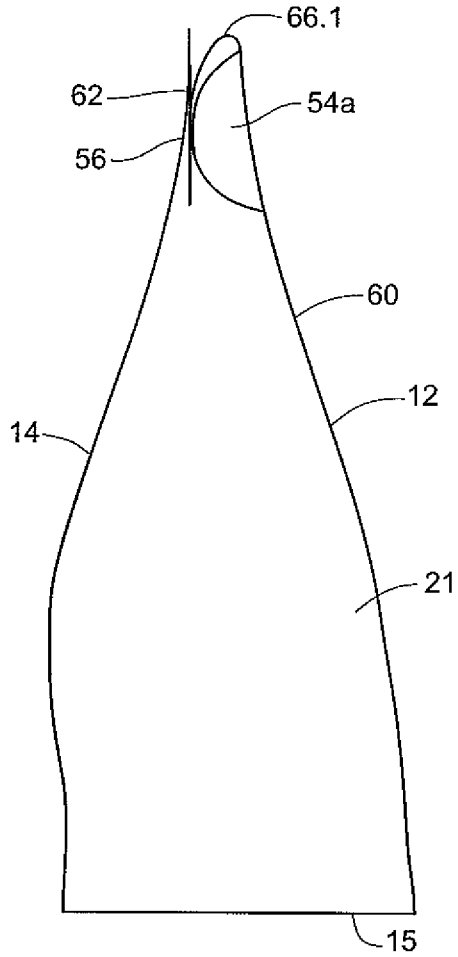
FIG. 36 is a cross-section of a single fluid-filled chamber having a protective flap in an embodiment of the invention.
Figure 36A:
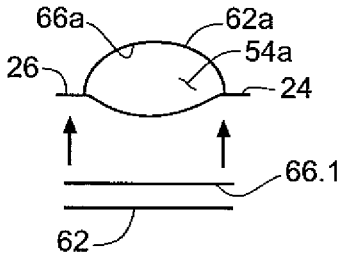
FIG. 36*a* is an exploded isolated view of a throat portion of FIG. 36.
Figure 36B:
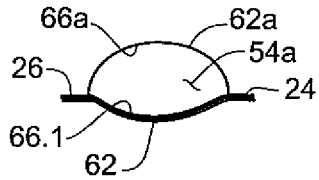
FIG. 36*b* is a view of an assembled throat portion of FIG. 36*a;*
Figure 37:
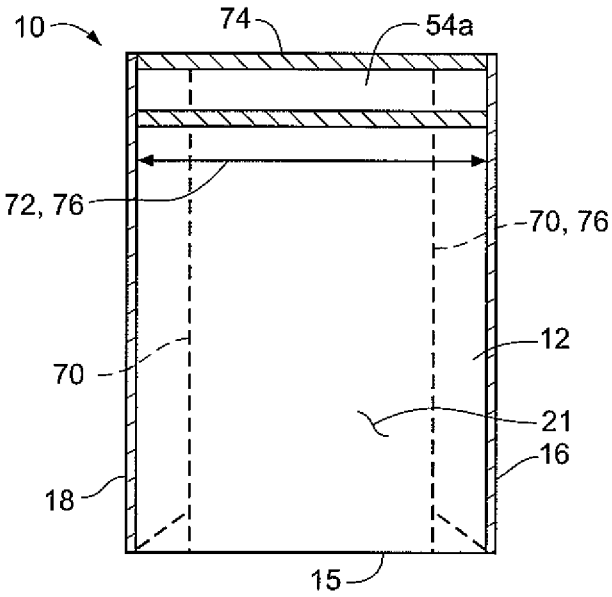
FIG. 37 is a front elevation view of a package with gusseted sides in an embodiment of the invention.
Figure 38:
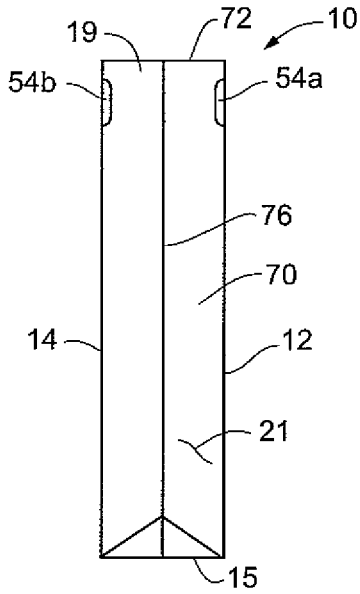
FIG. 38 is a side elevation view of the package of FIG. 37 in an open position.
Figure 39:
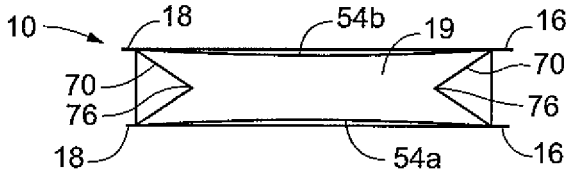
FIG. 39 is a top view of the package of FIG. 37 in an open position.
Figure 40:
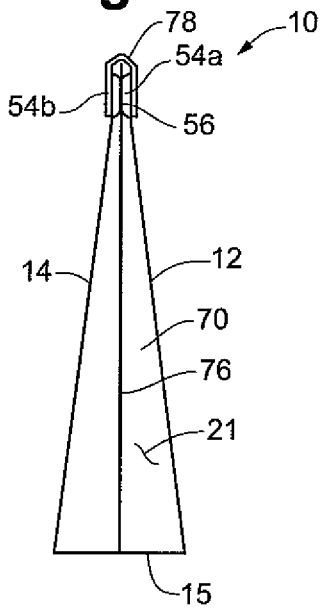
FIG. 40 is a side elevation view of the package of FIG. 37 in a closed position.
Figure 41:
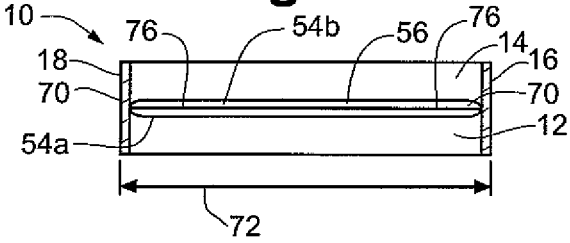
FIG. 41 is a top view of the package of FIG. 37 in a closed position.
Figure 42C:
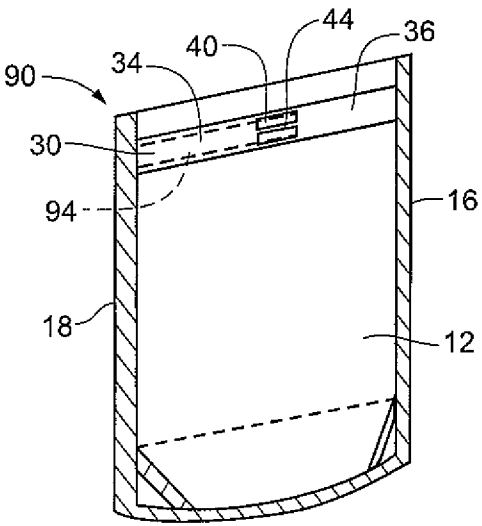
FIGS. 42A-42C are perspective views of a consumer filled flexible package with a fluid actuated closure mechanism in an embodiment of the invention.
Figure 42B:
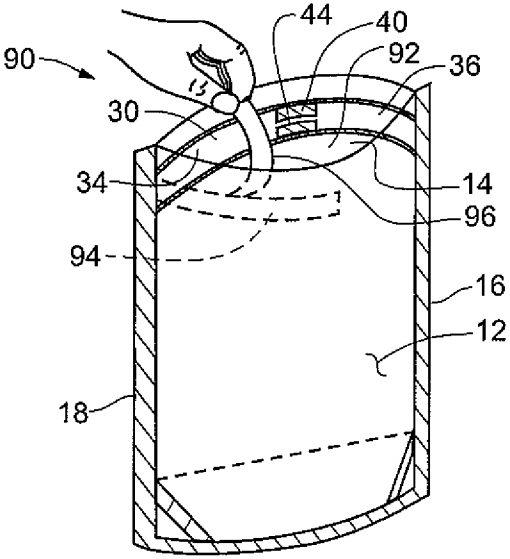
Figure 42A:
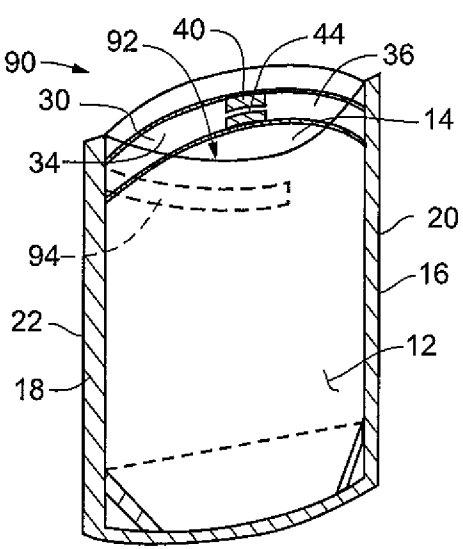
Figure 42D:
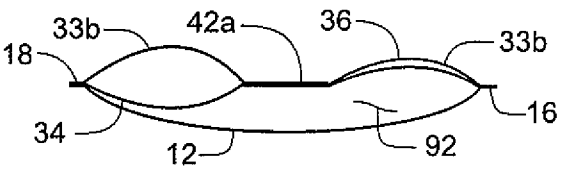
FIG. 42D is a sectional view of the closure mechanism of FIG. 42A with the fluid actuated closure mechanism in an opened or deflated state.
Figure 42E:
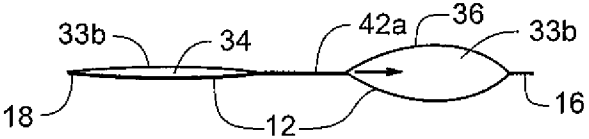
FIG. 42E is a sectional view of the closure mechanism of FIG. 42C with the fluid actuated closure in a closed position.

Referring to FIGS. 36, 36*a* and 36*b*, only the single fluid-filled chamber 54*a* is utilized in the throat portion 62 to effect the sealing interface 56 in an embodiment of the invention. The throat portion 62 and the single fluid-filled chamber 54*a* cooperate to form the interface area 56 therebetween, as shown in FIG. 36. The throat portion 62 may generally comply with the contour of the fluid-filled chamber 54*a*, thus mitigating against the formation of creases that may cause a leak path through the sealing interface 56.

A protective film or flap 66.1 may be included that shrouds at least a portion of an exterior surface of the single fluid-filled chamber 54*a* and extends interstitially between the fluid-filled chamber 54*a* and the throat portion 62. Such a configuration would include two sealing surfaces 56—one between the flap 66.1 and the fluid-filled chamber 54*a*, the other between the flap 66.1 and the throat 62.

In other embodiments of the invention, a throat-shaped portion is not required and the interface area 56 can be configured for any known package 10 design to provide regulation of contents out of, or access into the package through the opening, whether by two opposing fluid chambers or by a single fluid chamber in cooperation with an opposing member.

In operation, the top seal 64 may provide a secure seal that ensures the retention of the contents and the integrity of package 10 during shipping and handling. The contents of package 10 may be extracted by tearing off or cutting off the top seal 64 (FIG. 35) and causing an internal pressure that separates the members defining the interface area 56 for selective breaching thereof, enabling the contents of the package 10 to flow therethrough. The contents may also be removed through the conduit 65, for example by applying a suction force on the conduit 65 or by applying pressure to the package 10 that forces the contents through the conduit 65.

When utilized, the flap 66.1 may serve to protect the fluid-filled chamber 54*a* against puncture when inserting the conduit 65 or against other elements that may puncture the fluid-filled chamber 54*a*.

The contact pressure of the interface area 56 may be tailored during the formation of the throat portion 62 and fluid-filled chambers 54*a* and 54*b* so that the internal pressure required to separate the fluid-filled chambers 54*a* and 54*b* meets a specified criterion. The pressure at the interface area 56 as formed above is a function of several parameters, including the pressure and compressibility of the fluid within the fluid-filled chamber(s) 54*a*, 54*b*, the dimension D of the protrusion away from the recesses, and the thickness and stiffness (modulus of elasticity) of the materials that comprise the throat portion 62 and the fluid-filled chamber(s) 54*a*, 54*b*. For example, the fluid-filled chamber(s) 54*a*, 54*b* may be filled with a compressible gas such as air and have a wall thickness from 0.002- to 0.004-inches. A non-limiting and representative dimension D is on the order of 0.25-in. Higher internal pressures and greater protrusions D may tend to increase the pressure of the interface area 56, as may greater thickness and stiffness of the throat portion 62 and the fluid-filled chambers 54*a* and 54*b*.

Accordingly, in one embodiment, the contact pressure may be tailored to enable flow of the contents due merely to the initial hydrostatic forces caused when the package 10 is tipped on end (i.e. with the throat portion 62 positioned below the contents of the package 10). In another embodiment, the contact pressure may be increased so that the interface area 56 is maintained regardless of the orientation of the package, thus requiring an additional pressure be applied to the inner cavity 21 for the contents to flow out, such as by squeezing or shaking the package 10.

The fluid-filled chamber(s) 54*a* and/or 54*b* may also be tailored to substantially provide a seal 67 between the inner cavity 21 and the exterior surface of the conduit 65. The conduit may be used to inject or extract the contents of the package 10. The seal 67 may limit leaking or spilling of the contents of package 10 through the throat portion 62, even when the conduit 65 is in place, for example in where the user is engaged in a rigorous activity (e.g. walking, biking or jogging) or in situations where the user is unskillful (e.g. a toddler, handicapped or aged person). The seal 67 may also limit exposure of the contents of the inner cavity 21 to the ambient atmosphere compared to a configuration where the throat is simply open to atmosphere. The fluid-filled chambers 54*a* and 54*b* may also provide automatic sealing of the package 10 upon removal of the conduit 65, thereby limiting contamination and spilling of the contents of package 10 when the conduit 65 is not in place.

Referring to FIGS. 37-41, the package 10 that utilizes gusseted sides 70 is depicted in another embodiment of the invention. The fluid-filled chambers 54*a* and 54*b* located on opposing front and back panels 12 and 14 and extending along an internal width 72 of the package 10 may be positioned near a top end 74 of the package 10 such that when the package 10 is closed, the fluid-filled chambers 54*a* and 54*b* contact each other to define the interface area 56. In the embodiment depicted, each of the gusseted sides 70 are characterized by a crease 76 that extends between the fluid-filled chambers 54*a* and 54*b* to proximate the top end 74 of the package 10.

In the depicted embodiment, a clip 78 can be placed over the top end 74 of the closed package 10 to maintain the fluid-filled chambers 54*a* and 54*b* in the closed position. Other fastening means may be utilized, such as tape, tin ties or the like.

In the open position (FIGS. 37-39), the gusseted sides 70 may be in an extended or semi-extended position that enables the fluid-filled chambers 54*a* and 54*b* to remain substantially parallel to each other in the open position. In the closed position (FIGS. 40 and 41), the gusseted sides 70 are in a folded position with the creases 76 pinched between the fluid-filled chambers 54*a* and 54*b*. In this embodiment, the package TO is sealed near the ends of the fluid-filled chambers 54*a* and 54*b* by registering against the folded gusseted sides 70 pinched therebetween.

Functionally, the gusseted sides 70 provide a greater access opening to the internal cavity 21, enabling larger objects to be placed therein with greater ease, and full expansion of the package provided by the gussets. The interface area 56, when formed between the fluid-filled chambers 54*a* and 54*b* and between the fluid filled chambers 54*a*, 54*b* and the gusseted sides 70 in the pinched position, may isolate the cavity 21 from ambient atmosphere and prevent accidental spilling of the contents of the package 10.

Any of the fluid-filled chambers described herein can be constructed of multiple smaller pockets to define the larger chamber. Further, the fluid chambers can be separately applied to the package panels or integrally formed with the package (e.g., by folding a top or edge portion of the package onto itself), and could run the machine direction of the pouch or at other angles or directions. Additionally, the chambers and other devices could be applied during package formation or at any other time after the package is formed. Moreover, the fluid chambers may be applied to flexible, semi-rigid, or rigid packages, or a combination of such materials, to provide the sealing and closure structures and functions disclosed herein.

Referring to FIGS. 42A through 42E, a user filled flexible package 90 having an opening 92 in combination with the fluid actuated closure 30 is depicted in an embodiment of the invention. The user filled flexible package 90 may include at least one fluid actuated closure 30 attached to the front or back panel 12 or 14 of the flexible package 90. In one embodiment, the user filled flexible package 90 includes a two-sided tape 94, one side of which being adhered to the interior of the flexible package (e.g. to the font panel 12) and the other side being shielded by a release liner 96. The two-sided tape 94 may be adhered to a portion of the front panel 12 opposite the fluid actuated closure 30 as depicted. The two-sided tape may span the area of the fluid actuated closure 30 that includes the reservoir portion 34 and the restriction channel 44 or fluid regulator 40. Other known closure techniques and methods can be used instead of the tape 94 without deviating from the spirit and scope of the present invention.

In operation, the end user can open the entire or a substantial portion of the length of the opening 92 for placement of articles in the flexible package 90. After placement of the articles within the package 10, the end user can peal the release liner 96 off of the two-sided tape 94 and press the front and back panels 12 and 14 together causing the exposed inward face of the two-sided tape 94 to adhere to the reservoir portion 34 and the portion housing the restriction channel 44 or fluid regulator 40 of the fluid actuated closure 30. The two-sided tape 94 provides a seal between the front panel 12 and the reservoir portion 34/fluid regulator 44 portion. The fluid chamber 33*b* of the closure portion 36 may cooperate with the front panel 12 to provide a selective seal. The user can apply pressure to transfer the fluid between the reservoir portion 34 and the closure portion 36 to provide selective access into the cavity or to regulate material exiting or entering the package 10 through the access opening 92.

In another embodiment, designed to regulate material exiting or entering the package 10, the fluid may reside in the closure portion 36 only, confronting the opposing package side such as described attendant to FIGS. 32-36. In such an embodiment, the package 10 can be squeezed such that the contents of the package 10, e.g., fluid, is controllably released or forced out of the package 10, thus selectively breaching the interface area 56. In still another embodiment, with other embodiments described herein, two opposing fluid filled chambers 54*a*, 54*b* can be configured with the opening 92 as well.

The two-sided tape 94 may include an aggressive adhesive that renders an essentially permanent seal between the two-sided tape 94 and the sealed portion of the fluid actuated closure 30. Alternatively, the adhesive may be less aggressive, enabling the user to re-open the opening 92 and refill the flexible package therethrough several times. Sealing means other than the two-sided tape 94 can also be used with the user filled flexible package 90, such as zippers, pinch locks, hook and loop materials (e.g. VELCRO) and other sealing means available to the artisan. Whatever sealing means is used could be applied during the manufacturing of the package, or as a side operation before being placed on the market. It may even be sold as a kit, compete with instructions provided on a tangible medium for the consumer to apply the sealing means to the package themselves.

Figure 43A:
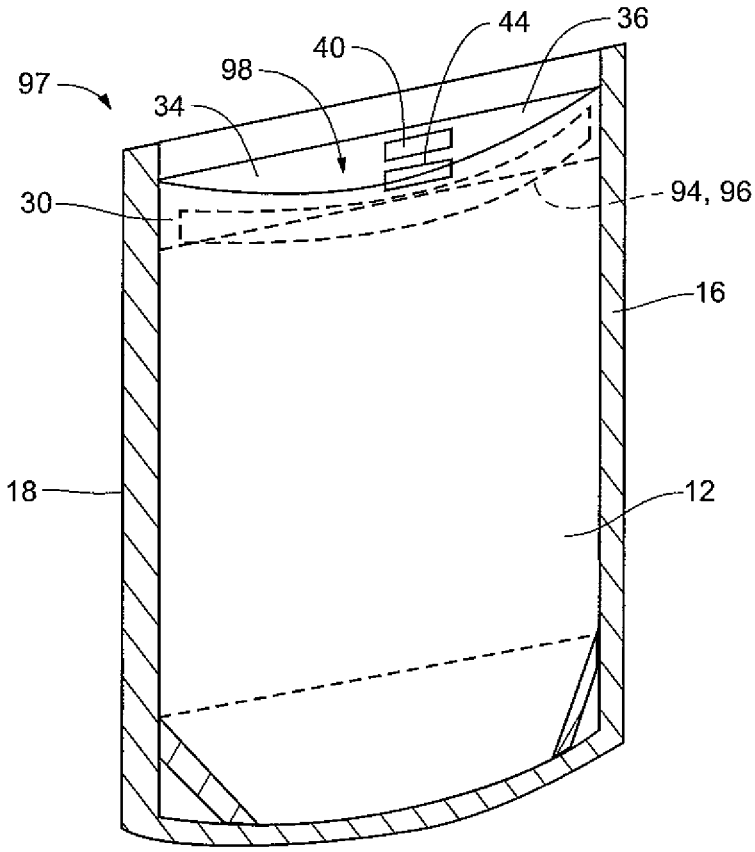
FIG. 43A is a perspective view of a flexible package having a fluid actuated closure mechanism in the closed position and an auxiliary access in an embodiment of the invention.
Figure 43B:
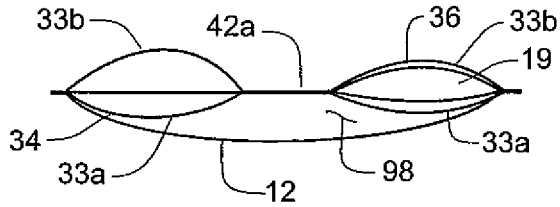
FIG. 43B is a top view of the flexible package of FIG. 43A with the fluid actuated closure in an open position.

Referring to FIGS. 43A and 43B, a flexible package 97 having an auxiliary access 98 is depicted in an embodiment of the invention. This embodiment is contrasted from the embodiment of FIGS. 42A-42E in that includes the dual fluid-filled chambers 33*a* and 33*b* and the auxiliary access 98 is distinct from the access opening 92. Accordingly, the two-sided tape 94 transverses substantially the length of the auxiliary access 98 for sealing the auxiliary access 98.

While FIG. 43A depicts the two-sided tape 94 for sealing, a variety of sealing means could be utilized, including but not limited to an adhesive, zippers, pinch locks, hook and loop materials.

The user filled flexible packages 90, 97 can be sold to the consumer empty. The consumer could, as with user filled packages (e.g. ZIP-LOC packages), purchase a number of the flexible packages 90 to store whatever products or articles they wish.

Referring to FIGS. 44A through 44E, a metered flexible package 100 including a main compartment 102 and a metered compartment 104 connected by a passageway 105 is depicted in an embodiment of the invention. The boundary between the main compartment 102 and the metered compartment 104 may be defined by one of the various fluid-filled chamber devices herein described, such as the single fluid filled chamber 54*a* disposed in the passageway 105 that cooperates with an opposing member 106 to define the interface area 56 (depicted) for sealing in the passageway 105. The metered flexible package 100 may include a handle portion 108.

The metered compartment 104 is so named because it may be sized to contain a quantity of product to within a known or acceptable uncertainty. The main compartment 102 may neck down to a throat portion 110 at the passageway 105. A selectively sealable closure 114 such as a pinch-lock seal (depicted) may be located at a distal end portion 116 of the metered chamber 104. The metered chamber 104 may also include vents 118 such as slots or perforations that enable air to pass between the metered chamber 104 and the ambient surroundings.

Figure 44A:
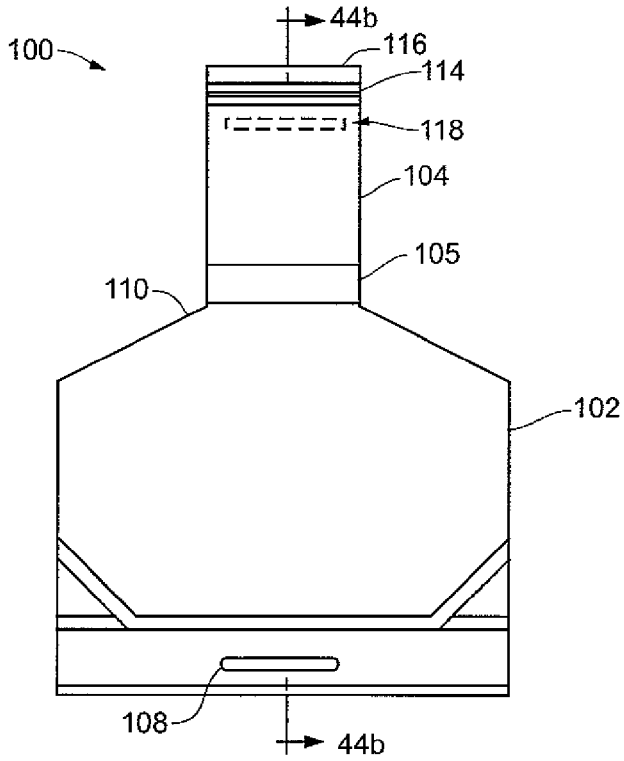
FIG. 44A is a front elevation view of a flexible package having a metered chamber in an embodiment of the invention.
Figure 44B:
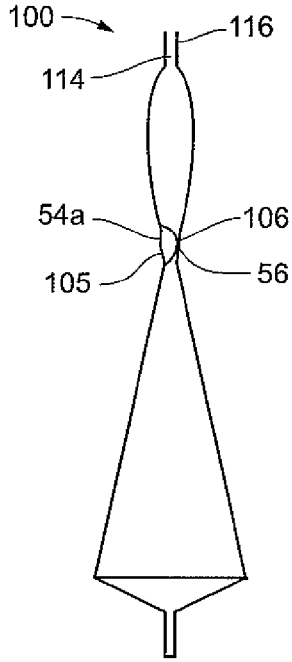
FIG. 44B is a side elevation view of the flexible package of FIG. 44A.
Figure 44C:
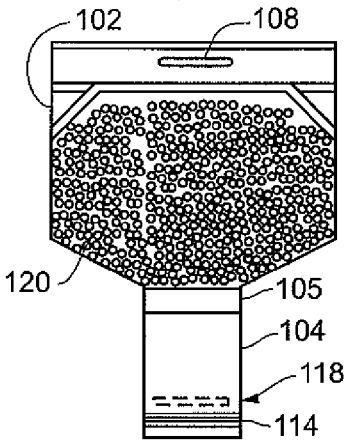
FIGS. 44C through 44E depicts use of the flexible package of FIG. 44A.
Figure 44D:
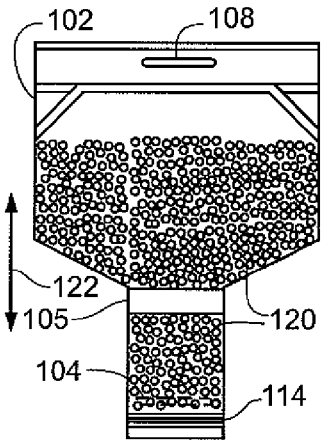
Figure 44E:
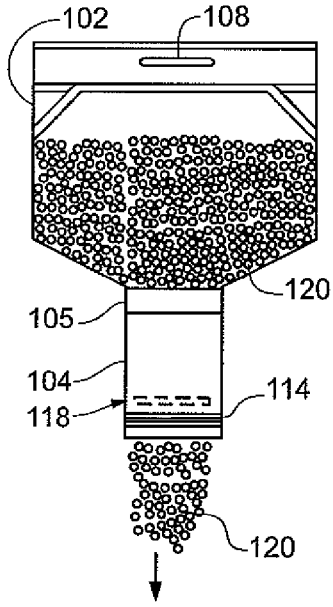

In use, the user orients the metered flexible package 100 containing a product 120 so that the metered chamber 104 is below the main chamber 102 (FIG. 44C). The user can shake the metered package 100, depicted by the up/down arrow 122. The shaking technique may be particularly effective for pellet-type products such as dry dog food. The down motions of the shaking motion 122 may cause a portion of the product 120 to breach the interface area 56 from the main chamber 102 into the metered chamber 104. The vents 118, when present, enable air that is displaced by the product 120 entering the metered chamber 104 to be pushed out of the metered chamber 104 while still containing the product 120. This process may continue until the metered chamber 104 is filled. When the metered chamber 104 is filled, the quantity of product 120 within the metered chamber is known to within an acceptable uncertainty. The user may then open the selectively sealable closure 114 to pour out the product 120 in the metered chamber 104.

Passage of product between the chambers 102, 104 of the metered flexible package 100 fluids may also be accomplished by squeezing one of the chambers 102, 104 so as to transfer product in to the metered chamber 104. Such and approach would be particularly suitable where the squeezed chamber contains a liquid. The concept of the metered flexible package 100 may be extended to include mixing of products located in adjacent chambers and separated by the fluid chamber closure (e.g. mixing two liquids or mixing a liquid with a granular product).

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive packages.

What is claimed is:

1. A flexible package for holding material, said package comprising:

a first panel portion having a first longitudinal edge portion and a second longitudinal edge portion;

a second panel portion opposite said first panel portion having a first longitudinal edge portion and a second longitudinal edge portion, said package defining an interior cavity between said first and second panel portions and an opening for access to said cavity, said first and second longitudinal edge portions of said first and second panel portions converging inward to define a narrowing funnel portion;

a generally bubble-shaped flexible and compressible closure feature provided with said first panel portion and disposed within said narrowing funnel portion and said opening to cooperate with an interior surface of said second panel portion to temporarily seal said opening.

2. The package of claim 1 wherein said generally bubble-shaped flexible closure feature contains a gas.

3. The package of claim 1 further comprising a fastening means that holds said generally bubble-shaped flexible closure feature in sealing contact with said second panel portion.

4. The package of claim 3 wherein said fastening means includes at least one of a tin-tie closure, a press-to-close closure, an adhesive strip, and a clip.

5. The package of claim 1 further comprising a gusset operably connected with said first and second panel portions.

6. The package of claim 1 further comprising side gussets operably connected with said first and second panel portions.

7. The package of claim 1 further comprising a flap that extends over at least a portion of said generally bubble-shaped flexible closure feature and through said opening.

8. The package of claim 1 further comprising a conduit inserted between said generally convex bubble-shaped flexible closure feature and said second panel portion to provide access to said package.

9. A device for sealing a flexible package, said device comprising:

a first panel portion and a second panel portion, each including first and second longitudinal edge portions converging inward to define a narrowing necking portion defining a boundary of an opening; and a deformable generally bubble-shaped feature provided with said first panel portion, said deformable generally bubble-shaped feature being disposed within said opening such that a surface of the deformable generally bubble-shaped feature is in contact with said second panel portion to define an interface area within said narrowing necking portion to temporarily seal said opening.

10. The device of claim 9 wherein said deformable generally bubble-shaped feature contains a gas.

11. The device of claim 9 wherein said first panel portion and said second panel portion are directly joined.

12. The device of claim 9 further comprising a gusset operably connected with said first panel portion, said gusset defining a boundary of said opening.

13. The device of claim 9 wherein said deformable generally bubble-shaped feature comprises a material having a high surface energy or static charge for clinging engagement of said interface area.

14. The device of claim 13 wherein said material comprises polyvinylidene chloride.

15. The device of claim 9 wherein said interface area remains closed regardless of the orientation of said package.

16. The device of claim 15 wherein said interface area is selectively breachable by applying an external pressure to said flexible package.

* * * * *